US008622378B2

(12) United States Patent
Sekigawa

(10) Patent No.: US 8,622,378 B2
(45) Date of Patent: Jan. 7, 2014

(54) SHEET PROCESSING APPARATUS AND IMAGE FORMING APPARATUS

(75) Inventor: Akito Sekigawa, Abiko (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 13/542,836

(22) Filed: Jul. 6, 2012

(65) Prior Publication Data

US 2013/0023396 A1 Jan. 24, 2013

(30) Foreign Application Priority Data

Jul. 20, 2011 (JP) ..... 2011-158572

(51) Int. Cl.
*B31F 1/08* (2006.01)

(52) U.S. Cl.
USPC ..... 270/45; 270/32; 270/37

(58) Field of Classification Search
USPC ..... 270/32, 37, 45, 46, 51; 412/22, 23; 493/406, 407, 442, 454
See application file for complete search history.

(56) References Cited

U.S. PATENT DOCUMENTS 7,681,872 B2 * 3/2010 Hayashi ..... 270/37
7,802,779 B2 * 9/2010 Kamiya ..... 270/45
7,922,162 B2 * 4/2011 Kamiya ..... 270/45
2007/0045919 A1 * 3/2007 Hayashi ..... 270/32
2008/0214377 A1 * 9/2008 Kamiya ..... 493/421
2010/0148416 A1 * 6/2010 Kayaba et al. ..... 270/4
2010/0187742 A1 * 7/2010 Sekigawa ..... 270/1.01
2011/0037215 A1 * 2/2011 Kamiya ..... 270/32

FOREIGN PATENT DOCUMENTS

JP 2008-184311 A 8/2008
JP 4871750 B2 2/2012

* cited by examiner

*Primary Examiner* — Leslie A Nicholson, III

(74) *Attorney, Agent, or Firm* — Fitzpatrick, Cella, Harper & Scinto

(57) ABSTRACT

The controller controls the folded bundle conveying portion such that, when a length in the conveying direction of the succeeding folded bundle makes the upstream edge in the conveying direction of the succeeding folded bundle, which is temporarily stopped for the folded end portion processing, remain within a stacking region of the sheet stacking portion, before the preceding folded bundle has been finally moved to the second stacking position, the succeeding folded bundle is conveyed until the upstream edge in the conveying direction of the succeeding folded bundle, to which the folded end portion processing has been applied, passes through outside the stacking region of the sheet stacking portion.

8 Claims, 23 Drawing Sheets

SHEET PROCESSING APPARATUS AND IMAGE FORMING APPARATUS

BACKGROUND OF THE INVENTION

1. Field of the Invention

The present invention relates to a sheet processing apparatus which performs a process of, for example, double folding a sheet bundle made of a plurality of sheets, and discharging the same so as to be stacked, and an image forming apparatus including this sheet processing apparatus.

2. Description of the Related Art

Conventionally, an image forming apparatus for forming an image on a sheet, such as a copying machine, and a laser beam printer, may be provided with a sheet processing apparatus for bringing a sheet, on which an image has been formed, into a bundle state, performing a binding process at the substantially central portion, and performing a folding process, etc., so as to perform a saddle stitch bookbinding. In a sheet processing apparatus illustrated in FIGS. 21 to 23, sheets, on which images have been formed, are stored in a storage portion 803 so as to be bundled, and a binding process is performed at a substantially central portion of the sheet bundle. Moreover, the sheet bundle is jabbed at its substantially central portion by a jabbing member 830 so as to be put into a nip portion of a pair of folding rollers 810. A double folding process is performed to the sheet bundle while being conveyed by the pair of folding rollers 810. Then, a folded end portion processing is performed in order to further strengthen the folded end portion of the sheet bundle (which is called "folded bundle" hereinafter) to which a double folding processing has been performed. After that, the folded bundle is discharged to a folded bundle tray 840 so as to be stacked (refer to Japanese Patent Laid-Open No. 2008-184311).

FIG. 20 illustrates a flow chart when a folding process is performed to a second copy or succeeding copies in the conventional apparatus mentioned above. When a saddle stitch bookbinding mode is selected, a sheet is stored in a storage portion 803, and aligning and stapling processes are performed (S101). After that, a sheet bundle, to which the stapling process has been performed, is jabbed by the jabbing member 830 at its substantially central portion where the stapling process has been performed so as to be pushed into the nip portion of the pair of folding rollers 810. A double folding process is performed to the sheet bundle while being conveyed by the pair of folding rollers 810 (S102). The folded bundle to which the folding process has been performed is stopped at a position where its folded end portion is subjected to a folded end portion processing by a press unit 860 (S103).

Then, the folded end portion processing is performed (S104), but, during this folded end potion processing, the folded bundle P1, which has already been discharged and stacked on the folded bundle tray 840, is positioned outside the moving region of the press unit 860 (FIG. 21). Then, after finishing the folded end portion processing of the succeeding folded bundle P2, conveyer belts 844, 845 are reversely rotated so that the folded bundle P1 positioned outside the moving region is moved back to a bundle receiving position adjacent to a pair of second folding conveying rollers 812 (S105, FIG. 22).

Note that the moving back amount L of this folded bundle is determined according to the kind of sheet to be used, such that, when the succeeding folded bundle P2 is discharged, the leading edge (the downstream edge in the conveying direction) of the succeeding folded bundle P2 is positioned downstream in the conveying direction of the trailing edge (the upstream edge in the conveying direction) of the preceding folded bundle P1 which has already been stacked.

After that, the folded bundle P2 is discharged to the folded bundle tray 840 (S106), and the conveyer belts 844, 845 are forwardly rotated so that the folded bundles are stacked in imbricate state, thereby preventing a sheet jam or a sheet bending (S107).

At this time, when the length of the folded bundle P2, to which the folded end portion processing is to be performed, in the conveying direction is included within bundle conveying guides 813, 814, the trailing edge of the folded bundle is located outside the storage region (stacking region) of the storage portion 803. Therefore, during the folded end portion processing of the folded bundle, a sheet of the succeeding sheet bundle can be conveyed to the storage portion 803.

However, when the length of the folded bundle P2, to which the folded end portion processing is to be performed, in the conveying direction is not included within the bundle conveying guides 813, 814, the trailing edge of the folded bundle remains in the storage region of the storage portion 803 (FIG. 23). In this case, after finishing the folded end portion processing, this succeeding folded bundle P2 cannot be discharged until the trailing edge of the preceding folded bundle P1, which has already been discharged and stacked on the folded bundle tray 840, is finally moved back to the position adjacent to the pair of second folding conveying rollers 812. Accordingly, the start of conveying the succeeding sheet bundle to the sheet storage portion is delayed, thereby causing a problem that the productivity is deteriorated in the conventional control method.

Moreover, if the conveying length of the bundle conveying guides 813, 814 is increased so as to correspond to the length of the folded bundle P2, to which the folded end portion processing is performed, in the conveying direction, such that the folded bundle P2 is included within the bundle conveying guides 813, 814, although the deterioration of productivity can be prevented, there is a problem that the size of apparatus is caused to be increased.

SUMMARY OF THE INVENTION

Therefore, the present invention is intended to enable the productivity to be enhanced without increasing the size of apparatus, even when the end portion of the folded bundle, to which the folded end portion processing is to be performed, remains in the stacking region where the succeeding sheet bundle is to be stacked.

According to the present invention, there is provided a sheet processing apparatus including: a sheet stacking portion on which a sheet being sent is stacked; a folding portion which performs a double folding process to a sheet bundle made of a plurality of sheets which are stacked on the sheet stacking portion; a folded bundle conveying portion which conveys a folded bundle double folded by the folding portion; a folded end portion processing portion which processes a folded end portion of the folded bundle by abutting the folded end portion and moving in a direction orthogonal to a conveying direction; a folded bundle stacking portion on which a folded bundle discharged from the folded bundle conveying portion is stacked; a folded bundle transfer portion disposed on the folded bundle stacking portion, the folded bundle transfer portion moving the folded bundle stacked on the folded bundle stacking portion between a first stacking position where an upstream edge thereof in a conveying direction does not interfere with the folded end portion processing portion during a folded end portion processing, and a second stacking position which is closer to the folded bundle conveying portion than the first stacking position, such that the upstream edge in the conveying direction of the folded bundle stacked on the folded bundle stacking portion is positioned upstream in the conveying direction of a downstream edge in the conveying direction of the folded bundle to be discharged by the folded bundle conveying portion; and a controller which controls operations of the folded bundle conveying portion, the folded end portion processing portion, and the folded bundle transfer portion, wherein the controller controls the folded bundle transfer portion so that, after a preceding folded bundle stacked on the folded bundle stacking portion has been moved to the first stacking position, the preceding folded bundle is moved to the second stacking position such that a succeeding folded bundle discharged to the folded bundle stacking portion abuts the preceding folded bundle, and controls the folded bundle conveying portion so that, in case the succeeding folded bundle has a length in the conveying direction that the upstream edge in the conveying direction of the succeeding folded bundle remains within a stacking region of the sheet stacking portion when the succeeding folded bundle is temporarily stopped for the folded end portion processing, after the folded end portion processing has been applied, the succeeding folded bundle is conveyed until the upstream edge in the conveying direction of the succeeding folded bundle passes through outside the stacking region of the sheet stacking portion before the preceding folded bundle has been finally moved to the second stacking position.

According to the present invention, when the trailing edge of the folded bundle remains in the stacking region of the sheet stacking portion during the processing of the folded end portion, before finishing the moving back of the folded bundle stacked on the folded bundle stacking portion to the upstream of the conveying direction, the folded bundle, of which the folded end portion processing has been finished, is conveyed until the trailing edge thereof is moved out of the stacking region of the sheet stacking portion. With this, the sheet of the sheet bundle to be folded next can be conveyed to the sheet stacking portion with a timing earlier than that of the conventional apparatus, thereby, the productivity can be enhanced without changing the apparatus configuration or increasing the size of the apparatus.

Further features of the present invention will become apparent from the following description of exemplary embodiments with reference to the attached drawings.

DESCRIPTION OF THE EMBODIMENTS

Hereinafter, an exemplary embodiment of the present invention is described in detail with reference to the drawings. Note that, sizes, materials, shapes, or relative positions of components, which are described in the following embodiment, should be suitably changed according to the configuration and various conditions of the apparatus to which the present invention is applied. Accordingly, the scope of the present invention is not intended to be limited to them as long as there is no specific description.

(Image Forming Apparatus)

Figure 1:
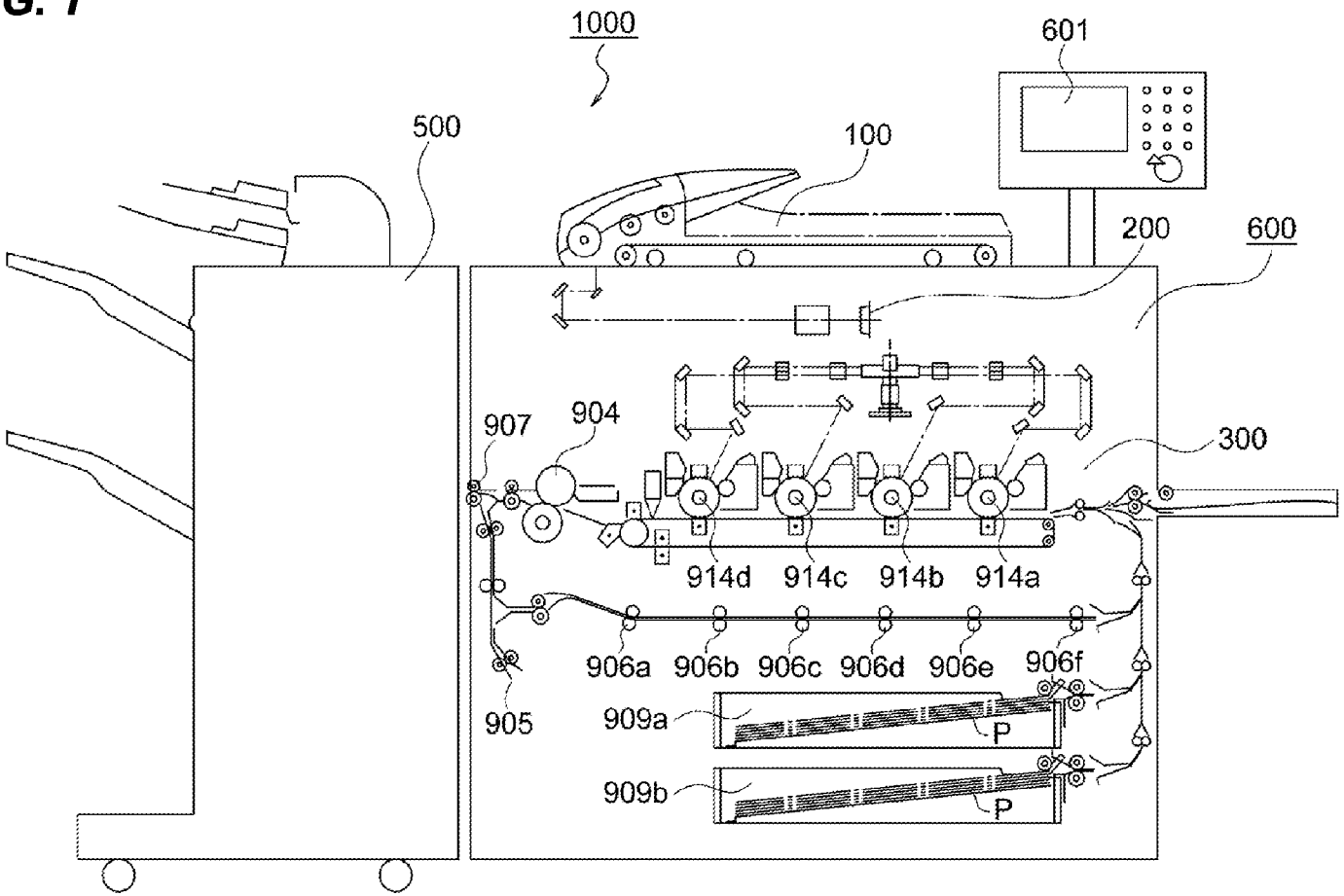
FIG. 1 is a cross-sectional view of an image forming apparatus provided with a sheet processing apparatus according to the present invention.

FIG. 1 is a configuration diagram of the image forming apparatus and the sheet processing apparatus. As illustrated in FIG. 1, the image forming apparatus 1000 includes an image forming apparatus main body 600 for performing a black-and-white/color image forming, and a saddle stitch bookbinding apparatus (which is called a "finisher" hereinafter) 500 as a sheet processing apparatus connected thereto. Accordingly, the sheet discharged from the image forming apparatus main body 600 can be processed by the on-line connected finisher 500.

Note that, the image forming apparatus main body 600 can be used independently without being connected to the discharge port of the finisher 500. The finisher 500 may be integrally assembled into the image forming apparatus main body 600 as a sheet discharging apparatus.

Here, the position where a user faces an operation portion 601 for performing various inputs/settings to the image forming apparatus main body 600 is called a front near side (a near side, hereinafter) of the image forming apparatus, and the apparatus rear side is called a back side. FIG. 1 illustrates the configuration of the image forming apparatus viewed from the apparatus near side. The finisher 500 is connected to the side portion of the image forming apparatus main body 600.

The image forming apparatus main body 600 includes an original feed portion 100, an image reader portion 200, and a printer portion 300. The original feed portion 100 sequentially feeds original copies sheet by sheet to the image reading position of the image reader portion 200. The image reader portion 200 reads an image of an original. The printer portion 300 is provided with an image forming portion including a photosensitive drum, a developing device, and a transferring portion. An electrostatic latent image formed on the photosensitive drum is developed by the developing device with toner based on image information of the original read by the image reader portion 200 or image information which has been sent. Then, the toner image is transferred to the sheet which has been timely fed to the transferring portion, and the transferred toner image is fixed by heat and pressure on the sheet in the fixing device so as to form an image.

A four color toner image is transferred on the sheet P fed from cassettes 909*a*, 909*b* in the image forming apparatus main body 600 by photosensitive drums 914*a* to 914*d* of yellow, magenta, cyan, and black, respectively constituting the image forming portions. The above sheet P is conveyed to a fixing device 904 so that a toner image is fixed thereon, and in a one-sided image forming mode, the sheet P is directly discharged from a pair of discharge rollers 907 outside the apparatus main body. In a two-sided image forming mode, the sheet P is transferred from the fixing device 904 to a reverse roller 905. When the trailing edge of the sheet in the conveying direction has been moved beyond a reverse switching portion, the reverse roller 905 is reversely rotated so as to be conveyed in the direction of both sides conveying rollers 906*a* to 906*f* which is opposite to the conveying direction. Then, a four color toner image is transferred again on the rear side of the above sheet P by yellow, magenta, cyan, and black photosensitive drums 914*a* to 914*d*, etc. The sheet P, in which images have been transferred on its both sides, is conveyed again to the fixing device 904 so as to fix the toner images, and discharged from the pair of discharge rollers 907 outside the apparatus main body.

(Finisher 500)

The finisher 500 is configured to align a plurality of sheets conveyed from the image forming apparatus main body 600, and process the sheets.

Figure 2:
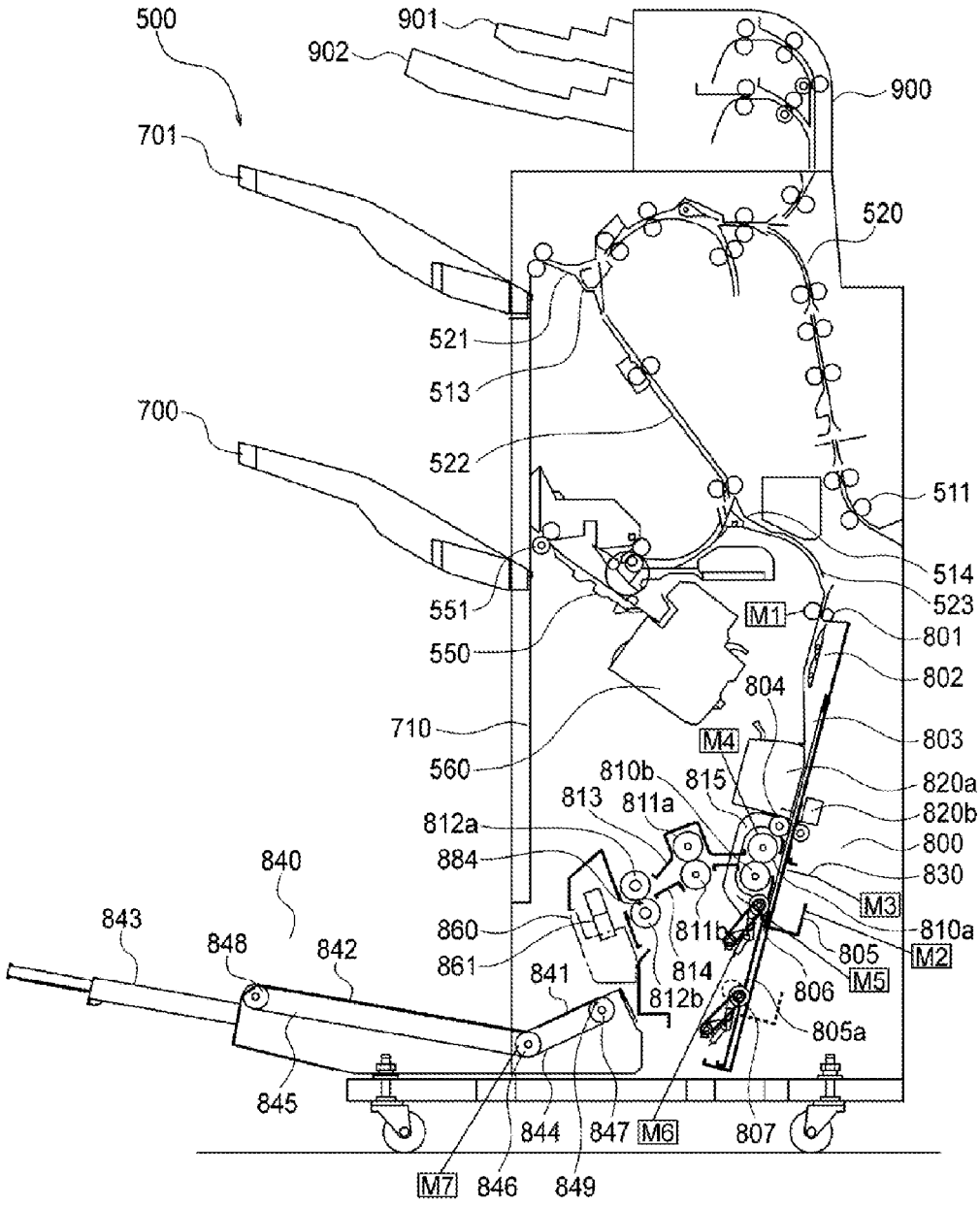
FIG. 2 is a cross-sectional view of the sheet processing apparatus according to the present invention.

As illustrated in FIG. 2, the finisher 500 includes a conveying path 520 for taking a conveyed sheet into the inside of the apparatus.

A switching member 513 disposed on the terminal of the conveying path 520 is configured to switch an upper discharge path 521 and a lower discharge path 522 which are connected to the downstream. The upper discharge path 521 is configured to guide the sheet to a sample tray 701. On the other hand, a switching member 514 is disposed in the middle of the lower discharge path 522. The switching member 514 guides the sheet to a process tray 550 or a saddle discharge path 523. The sheet, which has been guided to the saddle discharge path 523 by the switching member 514, is sent to a saddle stitch bookbinding portion 800.

The sheets, which have been discharged to the process tray 550, are sequentially aligned and stacked in a bundle state, and a sorting process or a staple binding process by a stapler 560 is performed thereto according to the setting from the operation portion 601 (FIG. 1). The processed sheet bundle is selectively discharged to a stack tray 700 or a sample tray 701 by a pair of bundle discharge rollers 551.

The stack tray 700 and the sample tray 701 are configured to be lifted and lowered along the apparatus main body of the finisher 500. The upper sample tray 701 is configured to receive sheets from the upper discharge path 521 and the process tray 550. The lower stack tray 700 is configured to receive sheets from the process tray 550. Thus, the stack tray 700 and the sample tray 701 are configured to be stacked with a large amount of sheets. The stacked sheets are stopped at their trailing edges by a trailing edge guide 710 extending vertically so as to be aligned.

(Saddle Stitch Bookbinding Portion)

Next, the configuration of the saddle stitch bookbinding portion 800 as the sheet processing apparatus is described.

The sheet, which has been sent to the saddle stitch bookbinding portion 800, is transferred to a pair of saddle inlet rollers 801, and a receiving entrance is selected by a switching member 802 which is operated by a solenoid according to its size so as to be conveyed into a storage portion 803 as the sheet stacking portion. The storage portion 803 is inclined such that the downstream side in the sheet conveying direction is lower than the upstream side. The taken-in sheet is continued to be conveyed by a slide roller 804 and transferred to a first feed roller 806 and a second feed roller 807 which are also disposed at a downstream side. The slide roller 804 is a roller having slippage, and the first feed roller 806 and the second feed roller 807 also have slippage similar to the slide roller 804. The first feed roller 806 and the second feed roller 807 are sheet bundle pressing portions which are movable between the abutment position for pressing the sheet to the sheet stacking face of the storage portion 803 (solid line position in FIG. 2) and the retracted position for releasing the press of the above sheet (broken line position in FIG. 2).

The pair of saddle inlet rollers 801 and the slide roller 804 are driven by an inlet roller motor M1. The first feed roller 806 and the second feed roller 807 are driven by a feed roller motor M6.

The sheet, which has been conveyed to the storage portion 803, is conveyed until its edge portion (the downstream edge in the conveying direction) abuts an edge portion stopper 805 which has been preliminary moved to a predetermined position according to the sheet size (the length of the sheet in the conveying direction). The edge portion stopper 805 can be moved in the sheet conveying direction along the sheet stacking face which is inclined lower on the downstream side of the storage portion 803 in the sheet conveying direction than the upstream side, and can be moved in the sheet conveying direction by the driving force of an edge portion stopper moving motor M2. The edge portion stopper 805 has a restriction face 805*a* protruding from the storage portion 803 so that the edge portion of the sheet, which has been conveyed to the storage portion 803, on the downstream side in the sheet conveying direction is received and held by this restriction face 805*a*.

The edge portion stopper 805 receives a sheet at a first receiving position or a second receiving position which are spaced apart from each other by a given range on a respective downstream side of the first feed roller 806 or the second feed roller 807. The first receiving position is the position illustrated in FIG. 2 as a solid line, and is the receiving position downstream of the first feed roller 806 by a preliminary set space so as not to buckle the sheet. The second receiving position is the position illustrated in FIG. 2 as a broken line, and is the receiving position downstream of the second feed roller 807 by the same space as the above space. Here, the given range means a range in which the sheet is not buckled even when conveying force of the feed roller is further applied to the sheet after being abutted against the above restriction face 805*a*.

Because the easiness of buckling (bending) of a sheet is proportional to the length of the sheet in the conveying direction, the receiving position by the edge portion stopper 805 is preferred to be short within the above given range. Here, the above given range is set from 15 to 30 mm, depending on the stiffness (basis weight) of the sheet and the conveying force of the feed roller. Note that this value is determined by an experiment etc., and is not limited to the above value. When the previously stored sheet is buckled, the buckled sheet blocks the entrance path for the next sheet to be stored, thereby causing a paper jam. Accordingly, the above given range is set within the range in which no paper jam occurs.

In the middle of the storage portion 803, there is disposed a stapler 820 including portions which are positioned opposite to each other over the storage portion 803. The stapler 820 is a binding portion for binding the bundle made of a plurality of sheets stored in the storage portion 803 at its central portion in the conveying direction. The stapler 820 is divided into a driver 820*a* for thrusting a staple, and an anvil 820*b* for bending the thrust staple, and staples the central portion in the conveying direction of the bundle made of the sheets when the storing of the sheets has been completed.

Therefore, the receiving position where the sheet edge portion is received by the edge portion stopper 805 is preferred to be located such that the moving distance to the staple binding position (or the folded position) is short, thereby shortening the processing time, or stabilizing the bundle conveyance. Here, the length from the above sheet edge portion to the position on the sheet to be processed is a half of the length L of the conveyed sheet in the conveying direction, i.e., L/2. Accordingly, a controller mentioned below determines whether the length L/2, which is a half of the length L of the conveyed sheet in the sheet conveying direction, is close to the first distance (length) L1 from the staple binding position to the restriction face at the first receiving position, or to the second distance (length) L2 from the staple binding position to the restriction face at the second receiving position. Then, the receiving position of the edge portion stopper 805 whose length to the staple binding position is closer to a half of the sheet length L, i.e., L/2, is selected.

On the downstream side of the stapler 820, a pair of folding rollers 810*a*, 810*b* and the jabbing member 830 are disposed via the storage portion 803 so as to be opposite to each other. The pair of folding rollers 810*a*, 810*b* and the jabbing member 830 constitute a folding portion which performs a double folding process at the central portion in the conveying direction of the sheet bundle which is made of a plurality of sheets stacked and stored in the storage portion 803.

The jabbing member 830 has a home position at the position where the jabbing member 830 is retracted from the storage portion 803, and protrudes toward the central portion in the conveying direction of the sheet bundle stored in the storage portion 803 by the driving force of a jabbing motor M3. With this, the above sheet bundle is pressed into the nip of the pair of folding rollers 810*a*, 810*b* so as to be double folded at the above central portion. After jabbing the sheet bundle, the jabbing member 830 is moved again back to the home position.

Note that, between the pair of folding rollers 810, there is applied pressure F1 by a spring (not shown) which is sufficient for making a fold on the sheet bundle. The sheet bundle provided with the fold (folded bundle) is discharged to the folded bundle tray 840 as the folded bundle stacking portion via a pair of first folding conveying rollers 811*a*, 811*b*, and a pair of second folding conveying rollers 812*a*, 812*b*. Also on the pair of first folding conveying rollers 811 and the pair of second folding conveying rollers 812 which constitute the folded bundle conveying portion, there are applied pressures F2, F3 which are sufficient for conveying and stopping the sheet bundle provided with the fold (folded bundle). Note that, the pair of folding rollers 810, the pair of first folding conveying rollers 811 and the pair of second folding conveying rollers 812 are rotated by the same folding conveying motor M4 at the constant velocity.

When the sheet bundle is folded without performing a binding process, the sheet bundle is moved such that the central portion in the conveying direction of the sheet bundle stored in the storage portion 803 is located at the nip position of the pair of folding rollers 810*a*, 810*b*. On the other hand, when the sheet bundle which has been bound by the stapler 820 is folded, after finishing the stapling process, the sheet bundle at the staple position (central portion in the conveying direction) is moved such that the stapled position of the sheet bundle is located at the nip position of the pair of folding rollers 810. With this, the sheet bundle can be folded around the position where the stapling process has been performed.

The movement of the sheet bundle from the sheet storage position (each receiving position) to the stapling position, or from the stapling position to the folding position, is performed by lowering or lifting the edge portion stopper 805 by the motor M2.

At the positions of the pair of folding rollers 810*a*, 810*b*, there are disposed a pair of aligning plates 815 having faces projecting to the storage portion 803 while extending along the outer circumferential faces of the pair of folding rollers 810*a*, 810*b*. The pair of aligning plates 815 are moved in the width direction orthogonal to the sheet conveying direction when receiving driving force of an aligning plate moving motor M5, so as to align (position) the sheet stored in the storage portion 803 in the width direction.

(Press Unit)

Figure 3:
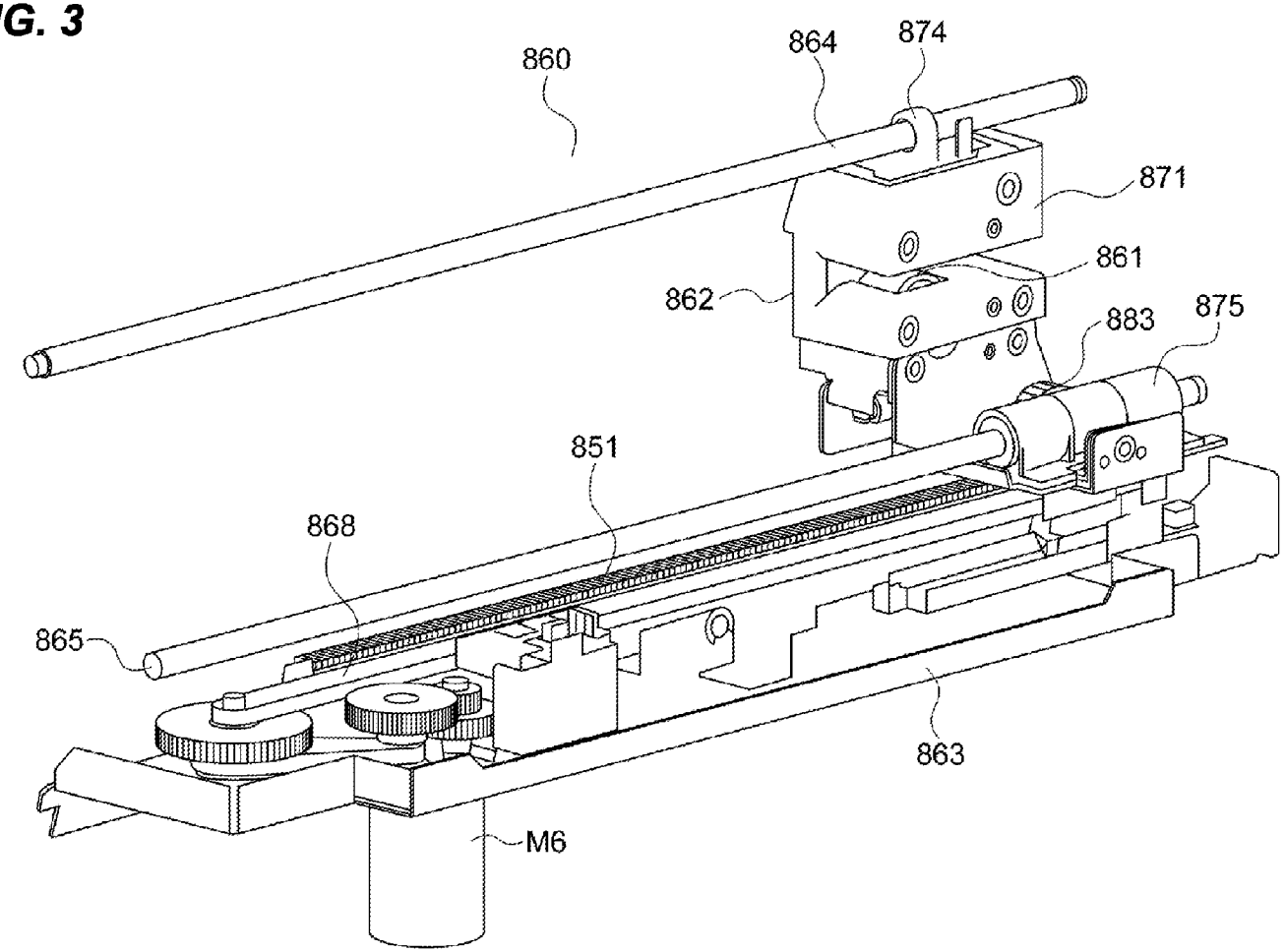
FIG. 3 is a perspective view of a press unit.
Figure 4:
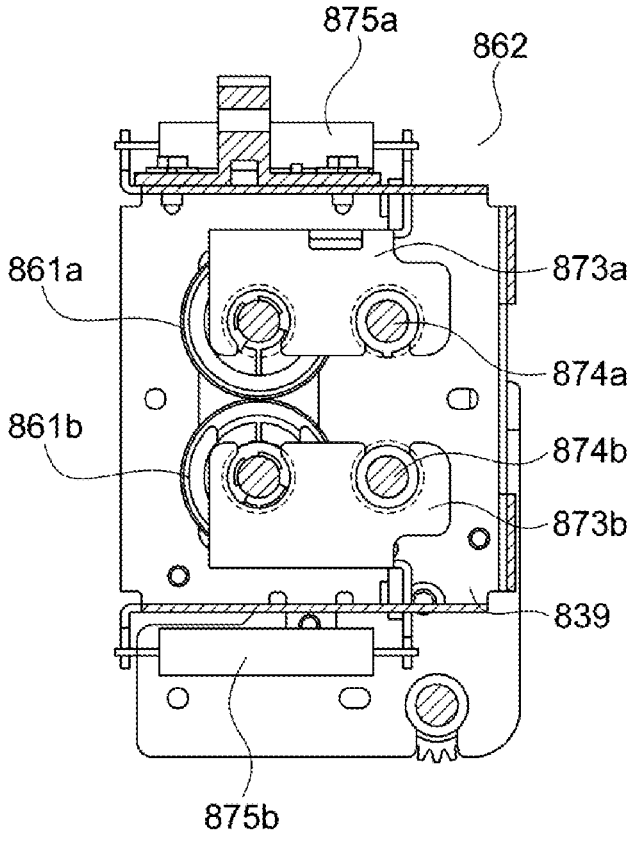
FIG. 4 is a front view of the press unit.

Next, the press unit 860 is described with reference to FIG. 3 and FIG. 4. FIG. 3 is a perspective view of the press unit, and FIG. 4 is an explanatory diagram of the inside of the press unit.

The press unit 860 is a folded end portion processing portion which processes the above folded end portion by moving in the direction orthogonal to the conveying direction while abutting the folded end portion of the double-folded sheet bundle (folded bundle).

As illustrated in FIG. 3, the press unit 860 includes a base metal plate 863 to which a main portion is incorporated, and two slide shafts 864, 865, and is fixed to the front and rear side plates. Two slide shafts 864, 865 extend in the sheet width direction orthogonal to the discharging direction of the folded bundle so as to be disposed side by side, and penetrate into slide bearings 874, 875 respectively fixed to a press holder 862 so as to support the press holder 862.

A pair of press rollers 861 are rotatably disposed on the above press holder 862, and a sheet guide 871 for the pair of press rollers 861 is disposed.

As illustrated in FIG. 4, press arms 873*a*, 873*b* are swingably supported via bearings on swing shafts 874*a*, 874*b* which are fixed on a frame 839. Tension springs 875*a*, 875*b* are disposed across the one ends of the press arms 873*a*, 873*b* and the frame 839, so that the pair of press rollers 861*a*, 861*b* nip with pressure which brings the pair of press rollers 861*a*, 861*b* close to each other. When the folded bundle is inserted into the pair of press rollers 861, the press arms 873*a*, 873*b* rotate around the swing shafts 874*a*, 874*b* as fulcrums so as to move the rollers apart from each other.

Moreover, a gear 883 illustrated in FIG. 3 meshes with a rack gear 851 which extends in parallel with the above slide shafts 864, 865 and is fixed to the base metal plate 863. Then, when the motor M6 is rotated, while the timing belt 868 is moved, the press holder 862 is moved while being supported by the slide shafts 864, 865. In this movement, the gear 883 of the press holder 862 is rotated while meshing with the rack gear 851. Therefore, driving force is also transmitted to the pair of press rollers 861*a*, 861*b* which are connected with the above gear 883 via gear trains (not shown). Note that, the above gear trains are set such that the moving velocity of the press holder 862 and the circumferential velocity of the two pairs of press rollers 861*a*, 861*b* are at the constant velocity.

When a folded end portion processing for strengthening the fold of the folded end portion at the pair of press rollers 861 is performed, the folded bundle, which has been folded at the pair of folding rollers 810*a*, 810*b*, is held by two or more pairs of rollers, regardless of the size to be processed. By holding like this, the folded bundle, to which the folded end portion processing is performed, is prevented from displacing by the movement of the pair of press rollers 861. Note that, the leading edge stop position (press leading edge position) of the folded bundle when the folded end portion processing is performed is controlled by using a bundle discharge sensor 884 disposed on the conveying guide 814 illustrated in FIG. 2, such that the relative relationship with the pair of press rollers 861 is kept constant regardless of the size.

On the other hand, regarding the folded bundle trailing edge position (press trailing edge position) when the folded end portion processing is performed, the positions of respective portions are determined such that the trailing edge is restricted by the storage portion 803 etc. so as to prevent the trailing edge from opening. When the length in the conveying direction is outside the storage region (stacking region) of the above storage portion 803, the position of the press trailing edge enables the storing operation of the sheets for forming the succeeding sheet bundle to the storage portion 803, and the aligning operation during the folded end portion strengthening processing is performed by the pair of press rollers 861. This contributes to the improvement of the productivity of the apparatus.

The folded bundle conveying guides 813, 814 illustrated in FIG. 2, including the press holder 862, are disposed so as to be included between the storage portion 803 and the trailing edge guide 710. This causes the effect of decreasing the size of the apparatus in the conveying direction, along with the spatially overlapping arrangement of the folded bundle tray 840 and the press unit 860.

(Folded Bundle Tray)

Next, the configuration of the folded bundle tray 840, which is the folded bundle stacking portion for stacking the folded bundle made by folding the sheet bundle, and conveying the same, is described with reference to FIG. 2.

As illustrated in FIG. 2, the folded bundle tray 840 is provided with a first stacking face 841, a second stacking face 842, and a third stacking face 843, successively in this order in the discharging direction of the folded bundle, and the folded bundle discharged from the pair of second folding conveying rollers 812 is stacked thereon.

The first stacking face 841 is disposed below the press unit 860 so as to partially overlap with the press unit 860 in the space in the vertical direction, and the downstream side in the conveying direction is inclined downward. The inclined angle is configured to be substantially equal to the discharging angle of the folded bundle by the pair of second folding conveying rollers 812 mentioned above. The top of the inclination is positioned as high as possible at the height where there is no interference with the operation of the press unit 860.

At the first stacking face 841 and the second stacking face 842, there are disposed the conveyer belts 844, 845 which constitute the folded bundle transfer portion for transferring the discharged folded bundle to the downstream side in the folded bundle discharge direction, or the upstream side.

The conveyer belts 844, 845 are disposed at the folded bundle tray 840. The conveyer belts 844, 845 move the preceding folded bundle stacked on the folded bundle tray 840 to the first stacking position where the trailing edge (upstream edge in the conveying direction) thereof does not interfere with the above press unit 860. Or, the conveyer belts 844, 845 move the above stacked preceding folded bundle to the second stacking position closer to the above press unit 860 than the above first stacking position. This second stacking position is a position which is set such that the trailing edge (upstream edge in the conveying direction) of the above stacked preceding folded bundle is positioned upstream in the conveying direction of the leading edge (downstream edge in the conveying direction) of the succeeding folded bundle discharged from the above press unit 860.

One end of each conveyer belt 844, 845 is wound around a drive pulley 846 adjacent to the bent portion. The other end of the first conveyer belt 844 is wound around an idler pulley 847, and the other end of the second conveyer belt 845 is wound around an idler pulley 848, so as to be parallel with the stacking faces. Then, respective conveyer belts 844, 845 are rotated in the same forward or reverse direction by receiving driving force of the conveyer motor M7 connected to the shaft of the drive pulley 846.

At the first stacking face 841, there is disposed a bundle detection sensor 849 capable of detecting the folded bundle stacked just below the operation region of the press unit 860, so that the stacking position of the discharged folded bundle is controlled based on the detection signal.

(Inserter)

Next, the configuration of an inserter 900 is described. As illustrated in FIG. 2, the inserter 900 is disposed on the upper portion of the finisher 500. The inserter 900 is configured to insert a sheet (insert sheet) which is different from a normal sheet into the sheets as the front page, the last page, or the intermediate page. Namely, the inserter 900 is configured to insert an insert sheet or a front page sheet between the sheets on which images have been formed by the printer portion 300 of the image forming apparatus main body 600.

The inserter 900 is configured to feed the sheet set on the insert trays 901, 902 by a user to one of the sample tray 701, the stack tray 700, and the folded bundle tray 840, without passing through the printer portion 300. The sheets stacked on the insert tray 901, 902 are sequentially separated sheet by sheet and merged with the conveying path 520 at a desired timing.

(Controller)

Figure 5:
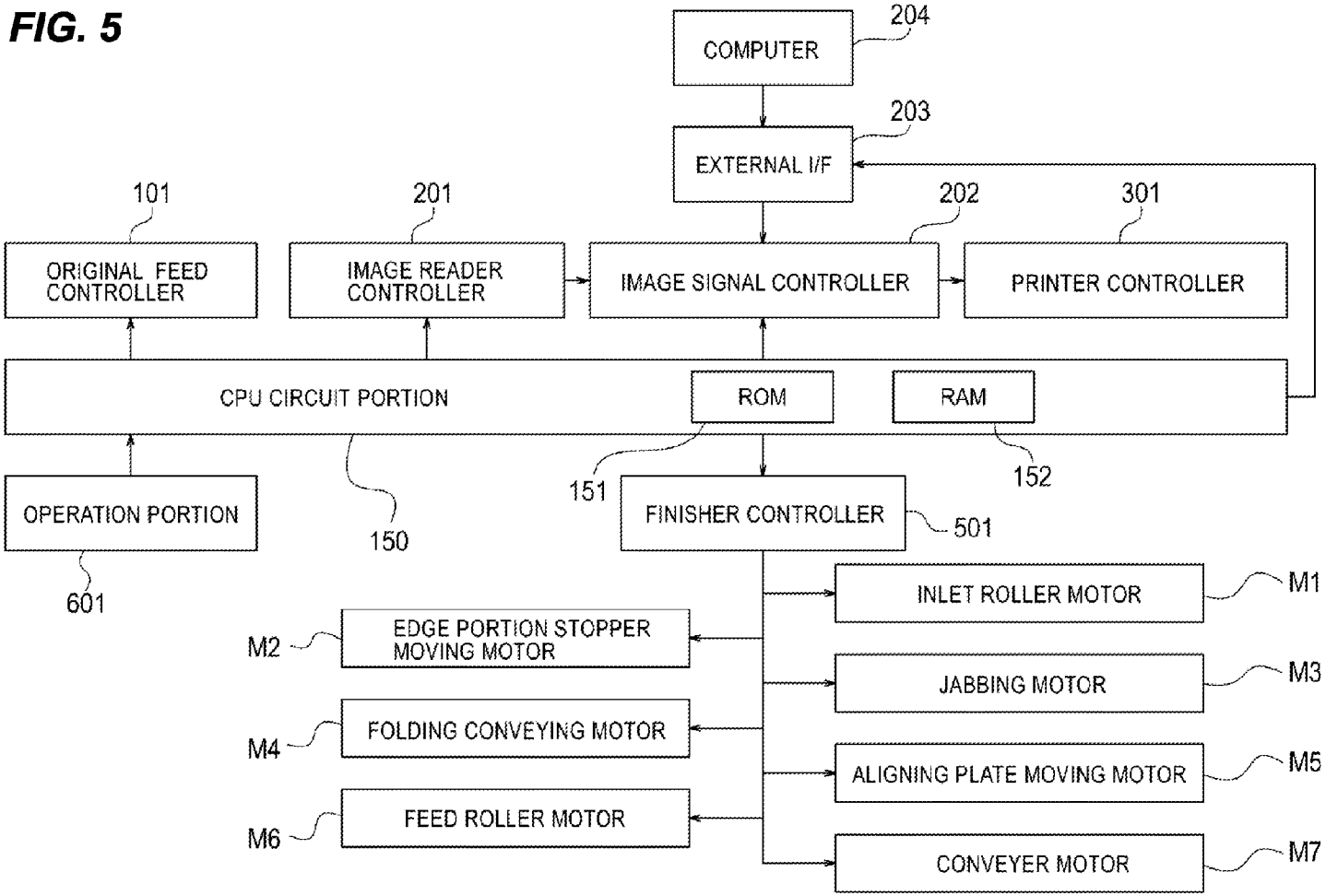
FIG. 5 is a block diagram of a controller.

Here, the control system of the image forming apparatus 1000 is described with reference to FIG. 5. FIG. 5 is a block diagram illustrating the configuration of the control system of the image forming apparatus 1000. A CPU circuit portion 150 is disposed at the printer portion 300, and includes CPU (not shown), ROM 151, and RAM 152. Then, the CPU circuit portion 150 controls the following respective portions according to the control program stored in the ROM 151 and the setting of the operation portion 601. Namely, the CPU circuit portion 150 controls an original feed controller 101, an image reader controller 201, an image signal controller 202, a printer controller 301, a finisher controller 501, and an external I/F (external interface) 203.

Then, the original feed controller 101 controls the original feed portion 100, the image reader controller 201 controls the image reader portion 200, and the printer controller 301 controls the printer portion 300. Moreover, the finisher controller 501 is disposed in the finisher 500 so as to control the finisher 500, the saddle stitch bookbinding portion 800, and the inserter 900. For details, respective motors M1 to M7 of the above saddle stitch bookbinding portion 800 are controlled to be driven by the finisher controller 501. Note that, the operation control of the saddle stitch bookbinding portion 800 performed by the finisher controller 501 is described later.

The operation portion 601 includes a plurality of keys for setting various functions regarding an image forming, and a display portion for displaying a setting condition, etc. The operation portion 601 outputs a key signal corresponding to the operation of each key by the user to the CPU circuit portion 150, and displays corresponding information on the display portion based on the signal from the CPU circuit portion 150.

RAM 152 is used as a region for temporarily holding the control data, and an operation region for calculation along with controlling. The external I/F 203 is an interface between the image forming apparatus 1000 and an external computer 204, and expands a print data from the computer 204 to a bit map image so as to output the same as an image data to the image signal controller 202. An image of an original read by the image sensor 109 is output from the image reader controller 201 to the image signal controller 202. The printer controller 301 outputs the image data from the image signal controller 202 to the exposure controlling portion 110.

Here, there is described the configuration in which the finisher controller 501 as the controller for controlling the operation of each portion of the saddle stitch bookbinding portion 800 which is described later is disposed in the finisher 500, but this is not the only case. For example, this controller may be disposed in the printer portion 300 integrally with the CPU circuit portion 150 so as to control the finisher 500 from the printer portion 300 side.

(Bookbinding Discharge Operation)

Figure 10:
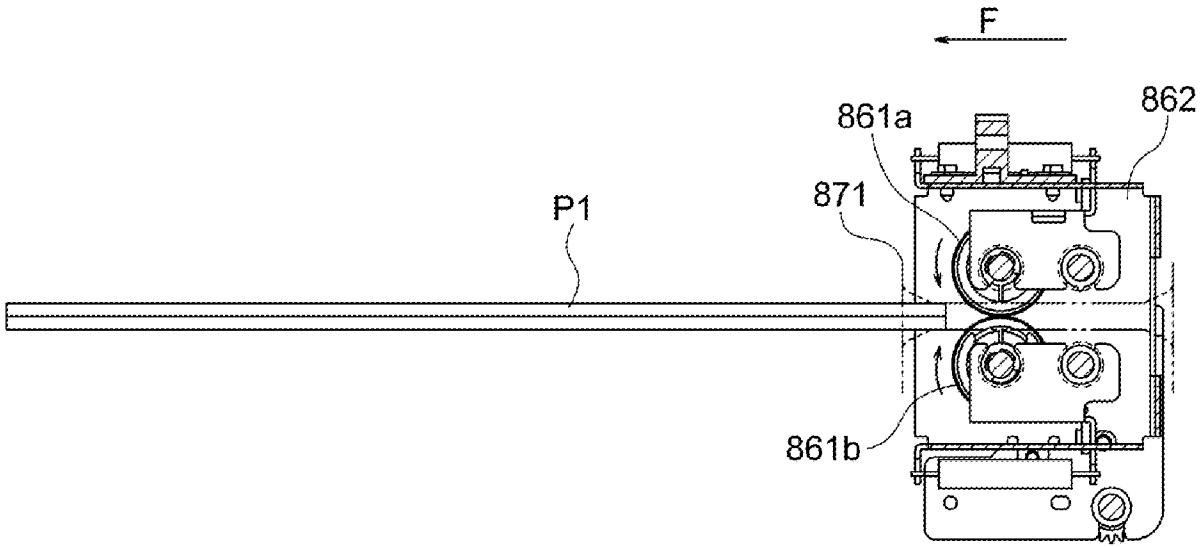
FIG. 10 is an explanatory diagram of a folded end portion processing operation.
Figure 11:
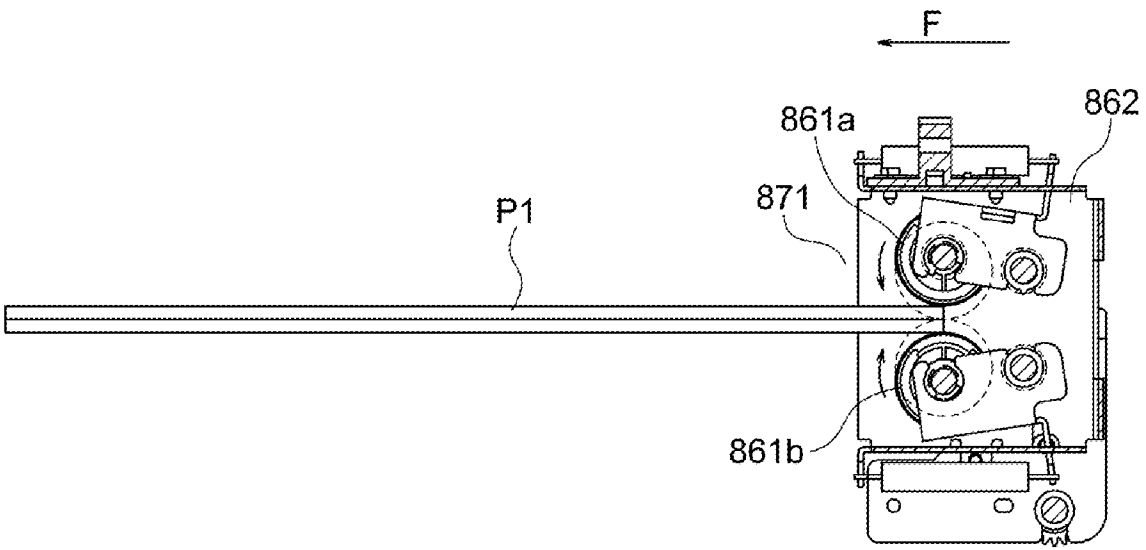
FIG. 11 is an explanatory diagram of a folded end portion processing operation.

Next, based on the above configuration, the saddle stitch bookbinding discharge according to the present embodiment is described with reference to FIGS. 6 to 11, regarding the operation of each portion, along with the flow of sheet. FIGS. 6 to 9 are cross-sectional views illustrating the operations of the saddle stitch bookbinding portion. FIGS. 10 and 11 are explanatory diagrams of the folded end portion processing operation.

When the saddle stitch bookbinding mode is set by the user (S201 of FIG. 17), the sheets, on which images have been formed and suitably applied with pagination, are sequentially discharged from the pair of discharge rollers 907 of the printer portion 300 (refer to FIG. 1).

As illustrated in FIG. 2, the sheet is transferred to the pair of inlet rollers 511 of the finisher 500, then, passes through the conveying path 520, and enters the lower discharge path 522. After that, the sheet is introduced to the saddle discharge path 523 by the switching member 514 in the middle of the lower discharge path 522.

Figure 6:
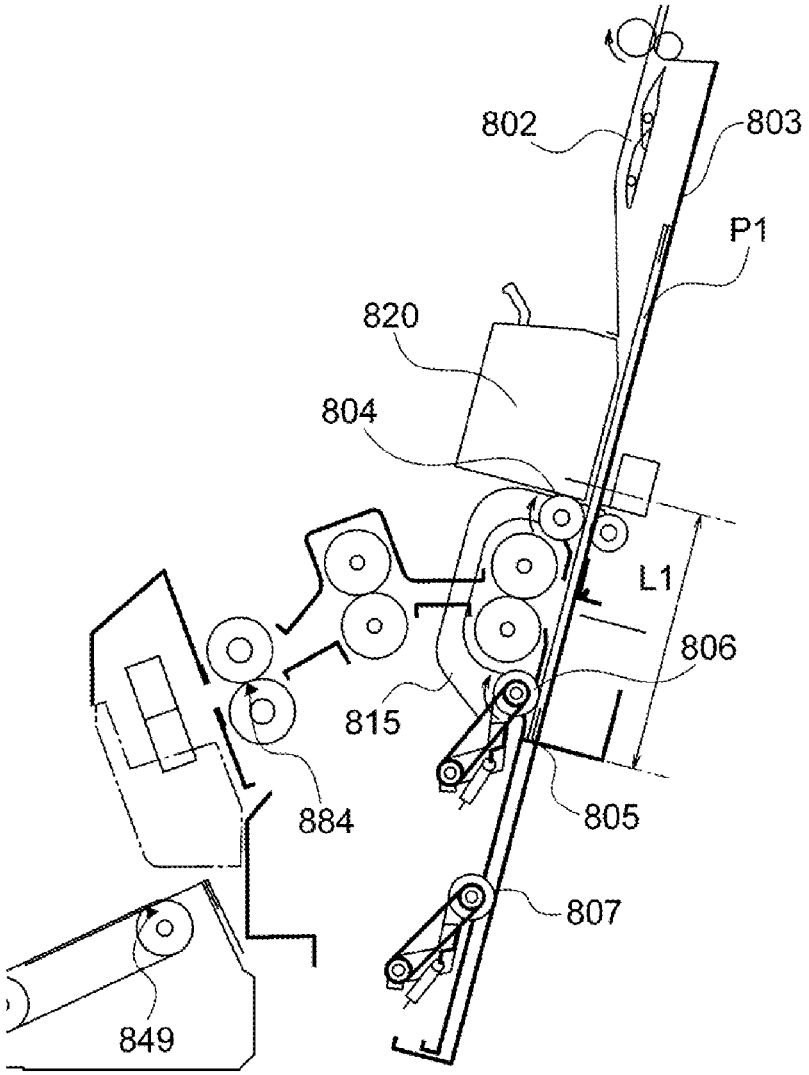
FIG. 6 is a cross-sectional view illustrating an operation of a saddle stitch bookbinding portion.

As illustrated in FIG. 6, the sheet is guided by the switching member 802 according to its size, and discharged to the storage portion 803. Moreover, while receiving conveying force of the slide roller 804, the first feed roller 806, or the second feed roller 807, the sheet is abutted against the edge portion stopper 805, which has been preliminarily stopped at a position suitable for the length in the conveying direction, so as to be positioned in the conveying direction.

Next, a sandwiching alignment is performed by the pair of aligning plates 815 which have been waiting at positions where the discharge of sheet is not disturbed, so that the sheets are also positioned in the width direction orthogonal to the sheet conveying direction. The above-mentioned sheet storing, and aligning operations are performed for each discharge of sheet.

Figure 7:
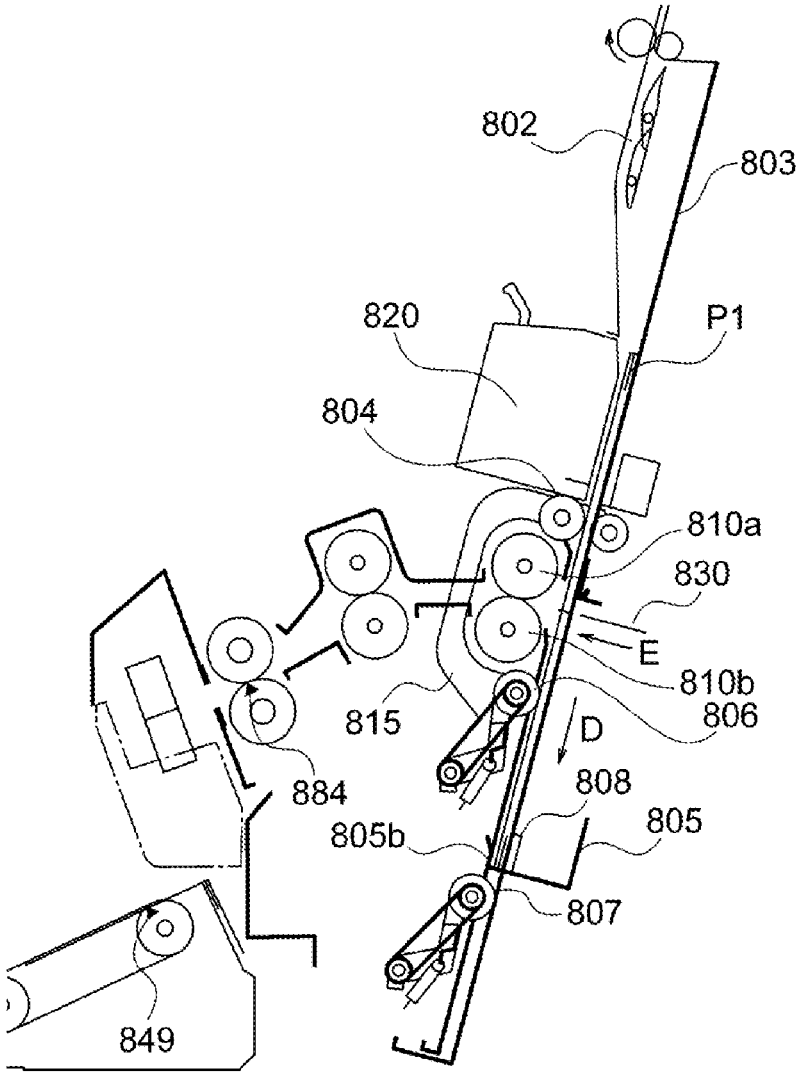
FIG. 7 is a cross-sectional view illustrating an operation of the saddle stitch bookbinding portion.
Figure 17:
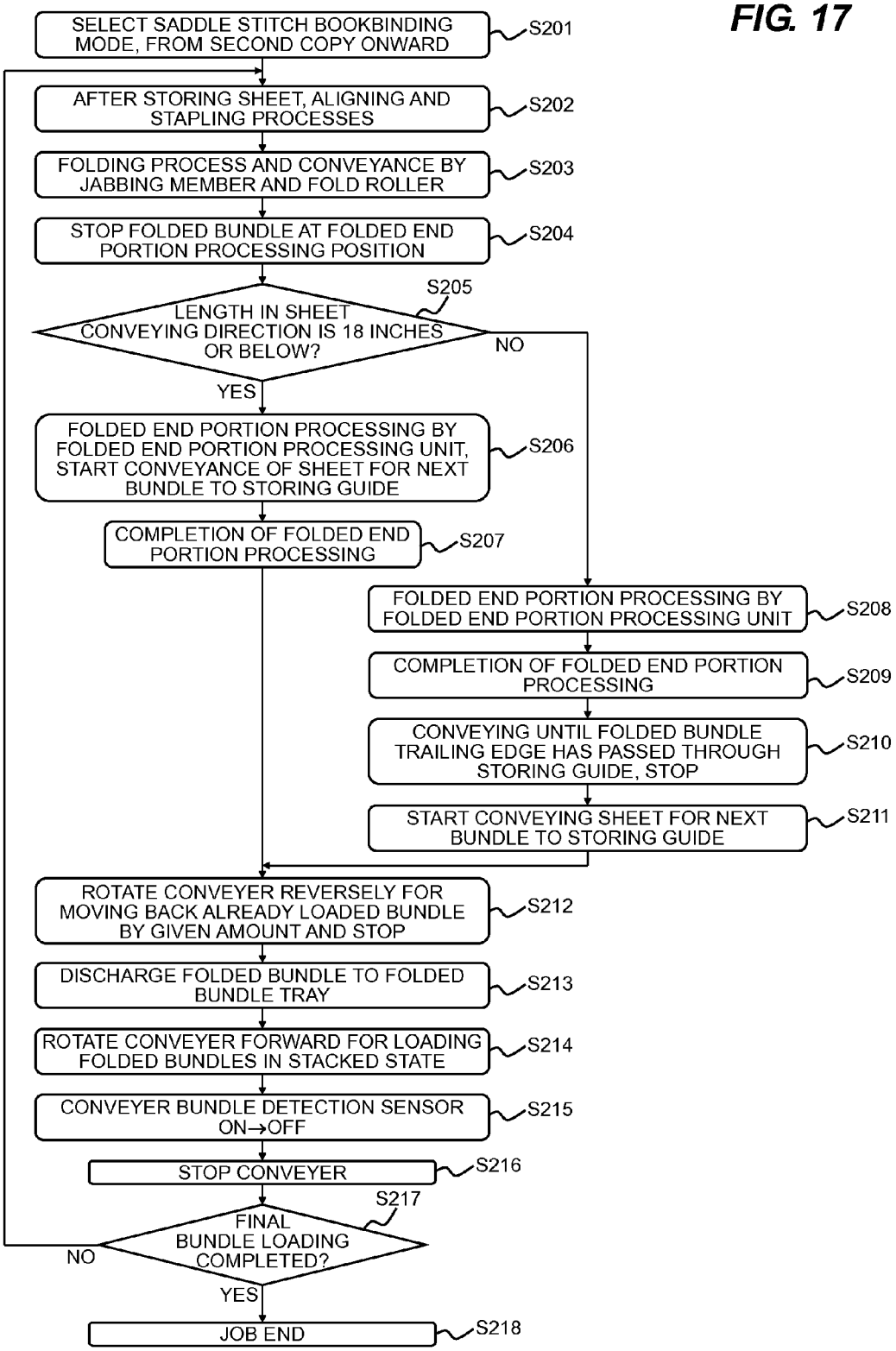
FIG. 17 is a flow chart illustrating a bundle discharging operation.

When the alignment of the last sheet for one sheet bundle has been finished, the stapler 820 performs a staple binding at the central portion in the conveying direction of the sheet bundle (S202 of FIG. 17). As illustrated in FIG. 7, the stapled sheet bundle P is moved downward (arrow D direction) according to the movement of the edge portion stopper 805. The edge portion stopper 805 is stopped at a position where the central portion of the sheet bundle, i.e., the stapled portion, is located so as to correspond to the nip of the pair of folding rollers 810.

Figure 8:
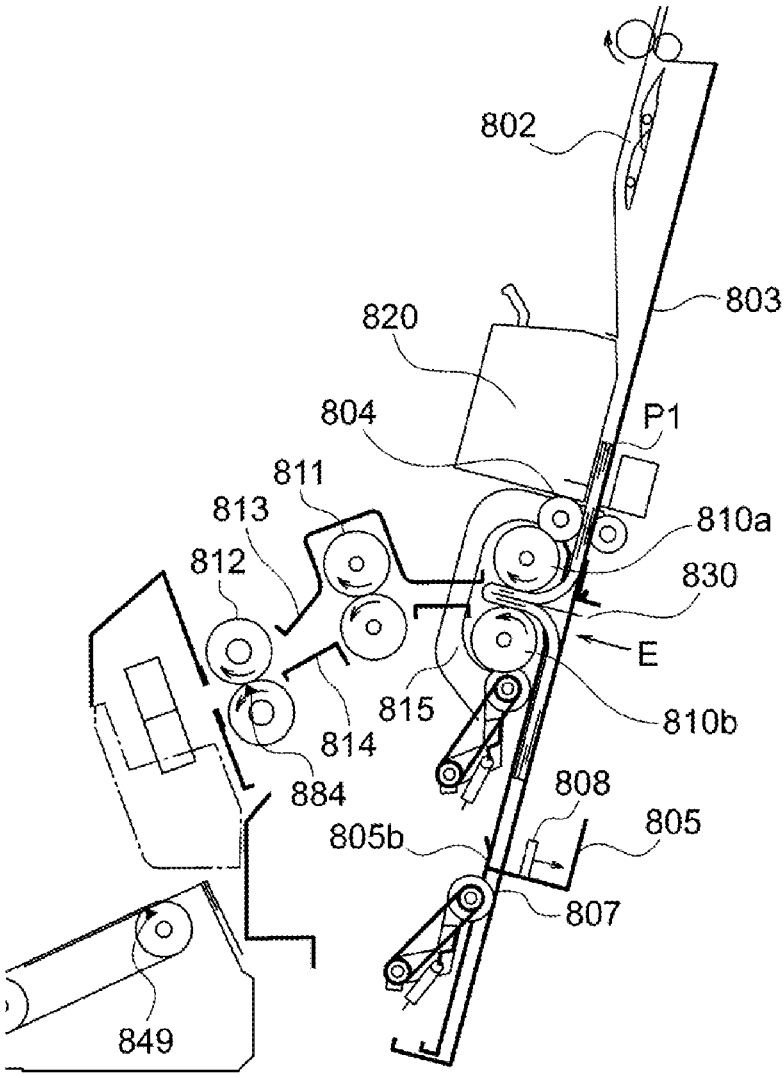
FIG. 8 is a cross-sectional view illustrating an operation of the saddle stitch bookbinding portion.

Next, the jabbing member 830, which has been located at the waiting position, is moved toward the nip portion of the pair of folding rollers 810 (arrow E direction). Then, as illustrated in FIG. 8, the sheet bundle P is moved such that its central portion is inserted into the nip portion of the pair of rollers so as to widen the nip between the pair of folding rollers 810, and is folded. At this time, the pair of folding rollers 810 are rotated in the arrow directions by receiving the driving force of the motor M4 along with the pair of first folding conveying rollers 811 and the pair of second folding conveying rollers 812. Accordingly, the folded bundle P is conveyed in the conveying guides 813, 814 with its folded end portion set to the leading position (S203 of FIG. 17).

Figure 9:
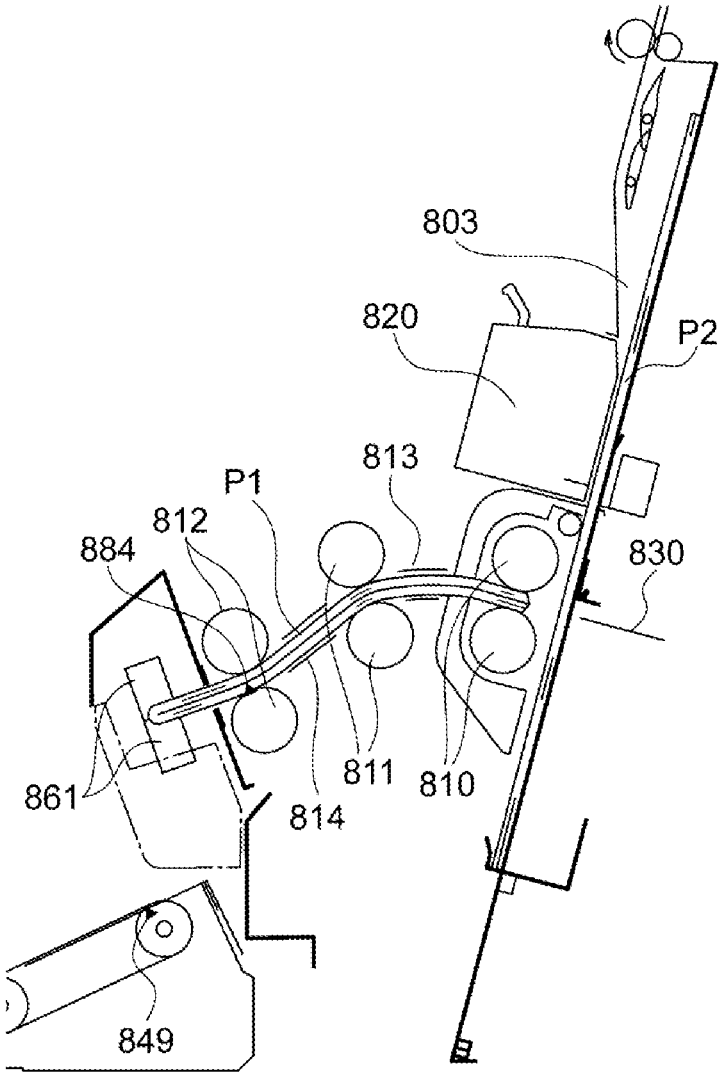
FIG. 9 is a cross-sectional view illustrating an operation of the saddle stitch bookbinding portion.

Then, as illustrated in FIG. 9, when the folded end portion of the folded bundle has been conveyed to the position where the folded end portion is to be nipped by the pair of press rollers 861, the motor M4 is stopped (S204 of FIG. 17). The stop position control is performed by detecting the leading edge of the folded bundle P1 by the sensor 884. At this time, as mentioned above, the folded bundle P1 is surely held, across the center in the conveying direction, at its leading edge portion by the pair of second folding conveying rollers 812, at its trailing edge side by the pair of first folding conveying rollers 811, and depending on the size of the folded bundle P1 (the length in the conveying direction), by the pair of folding rollers 810. Note that, the above jabbing member 830 is moved again to the retracted position after finishing the jabbing.

As illustrated in FIG. 10, when the folded end portion processing is performed, prior to the conveyance of the folded bundle P1, the press holder 862 waits at the waiting position (back side) according to the size (width direction) of the folded bundle P1. Then, the folded bundle P1 is temporarily stopped at a give position where the folded end portion is processed (folded end portion processing position). When the stopping of the folded bundle P1 has been completed, and the folded end portion of the folded bundle P1 has been inserted into the sheet guide 871 (broken line), the pair of press rollers 861 are rotated by receiving driving force of the motor M6 so as to start moving to the near side (arrow F direction).

After that, the pair of press rollers 861 abut side faces of the folded bundle P1, which is stopped and held, adjacent to the folded end portion. The pair of press rollers 861 themselves are driven at both sides to be rotated so as to be able to smoothly move onto the side faces and nip the folded end portion, as illustrated in FIG. 11. This effect cannot be changed even when the thickness of the folded bundle increases, and the folded bundle can be nipped by the pair of press rollers 861 in synchronization with the movement of the press holder 862 without a response delay, thereby preventing the folded bundle P1 from being wrinkled or broken, or suffering damage of roller rut etc.

When the pair of press rollers 861 has finished its moving, the press unit 860 is moved to the home position so as to open the path in the conveying direction of the folded bundle P1. By doing this, the pair of press rollers 861 process the folded end portion of the folded bundle, which has been temporarily stopped at a given position, by moving in the direction orthogonal to the conveying direction of the folded bundle.

Note that, the order of the following process operation for the preceding folded bundle which has been stopped at the folded end portion processing position and the process operation for the succeeding sheet bundle to be followed is different according to whether the length in the conveying direction makes the trailing edge of the preceding folded bundle remain within the storage region (stacking region) of the storage portion. This is described hereinafter.

(Moving Operation of Folded Bundle Stacked on Folded Bundle Tray)

Next, in the case that the length in the conveying direction does not make the trailing edge of the folded bundle (upstream edge in the conveying direction) remain within the storage region of the storage portion 803, there is described an operation control of the folded bundle which has already been discharged and stacked on the folded bundle tray 840 when a folded bundle is discharged, with reference to FIGS. 12 to 17. Note that, FIGS. 12 to 16 are explanatory diagrams of the bundle discharging operation. FIG. 17 is a flow chart illustrating the bundle discharging operation.

Here, the length in the conveying direction which does not make the trailing edge of the folded bundle remain within the storage region of the storage portion is the length of 18 inches or below in the sheet conveying direction before being folded. This length in the conveying direction is suitably set, and is not limited to this.

Figure 12:
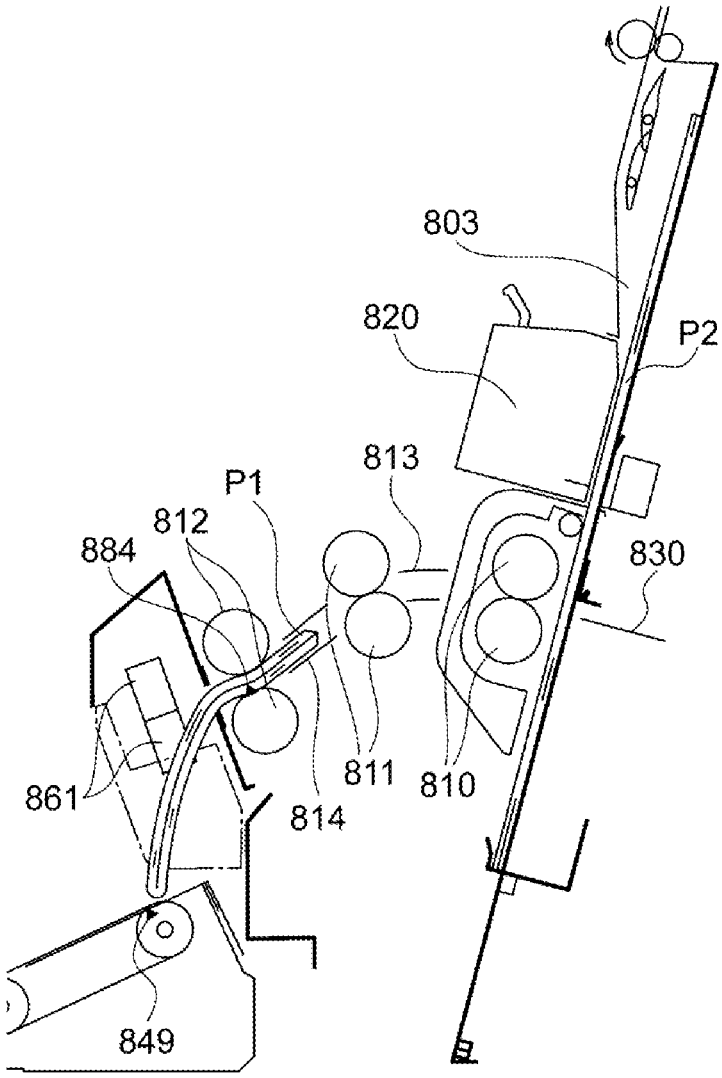
FIG. 12 is an explanatory diagram of a bundle discharging operation.
Figure 13:
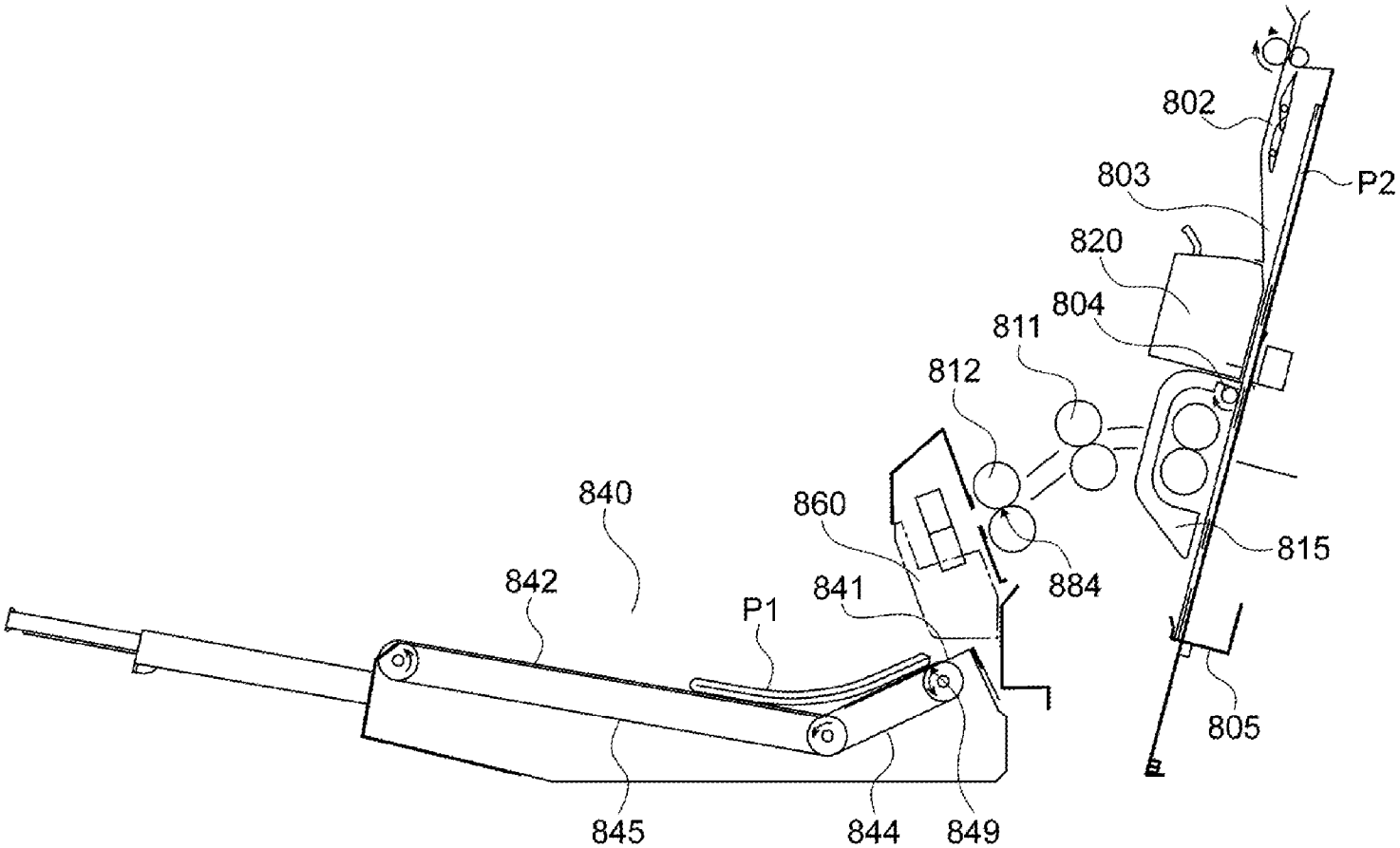
FIG. 13 is an explanatory diagram of a bundle discharging operation.

As illustrated in FIG. 12, the conveyer belts 844, 845 are started to rotate in the conveying direction by the conveyer motor M7 at a given timing, and transfer the folded bundle P1 which has been discharged on the folded bundle tray 840. Then, as illustrated in FIG. 13, when the bundle detection sensor 849 detects the trailing edge of the folded bundle P1, the conveyer motor M7 is stopped (first stacking position). As mentioned above, because the bundle detection sensor 849 is disposed just below the operation region of the press unit 860, the trailing edge of the stopped folded bundle P1 is also outside the operation region of the press unit 860. Namely, the folded bundle P1 stacked on the folded bundle tray 840 is moved such that its trailing edge (upstream edge in the conveying direction) is moved to the first stacking position, where there is no interference with the press unit 860, outside the operation region of the press unit 860.

At the same time, the discharging and aligning operations for the sheets which constitute the next folded bundle P2 are continued, and the next folded bundle P2 is similarly applied with the folded end portion processing by the press unit 860. At this time, the trailing edge (upstream edge in the conveying direction) of the folded bundle P1 located in the above first stacking position is positioned downstream in the discharging direction of the operation region of the press holder 862 of the press unit 860. Accordingly, the discharged folded bundle P1 does not disturb the folded end portion processing by the press unit 860.

Figure 14:
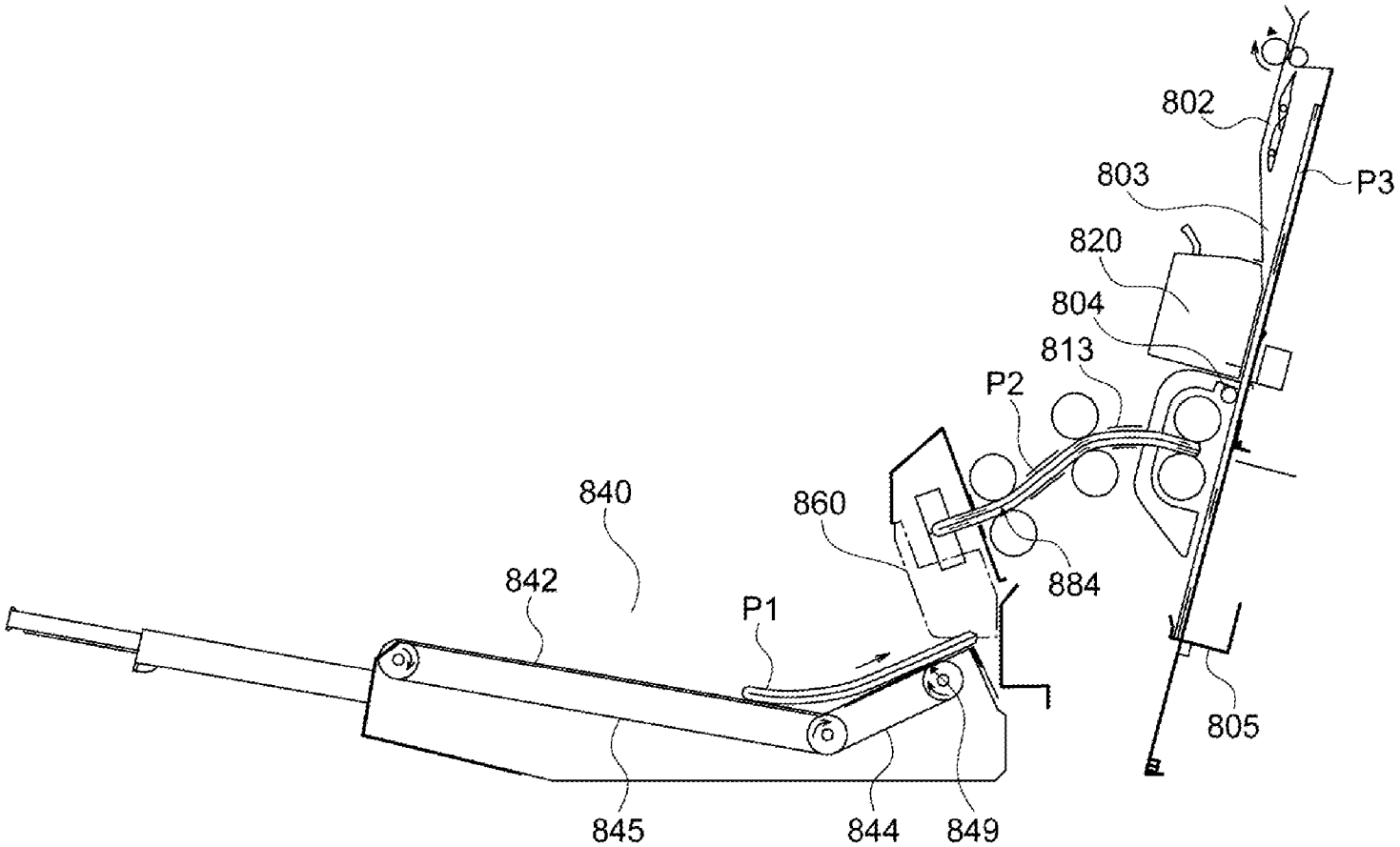
FIG. 14 is an explanatory diagram of a bundle discharging operation.

Then, as illustrated in FIG. 14, the folded end portion processing for the next folded bundle P2 as the second copy is performed, and the press unit 860 is moved to the home position so as to finish the folded end portion processing. After finishing this folded end portion processing (S207), the conveyer belts 844, 845 receive driving force from the conveyer motor M7 so as to rotate in the direction opposite to the conveying direction of the folded bundle. Then, the folded bundle P1 at the first stacking position is moved back to the position (second stacking position) which is upstream of the first stacking position and closer to the pair of second folding conveying rollers 812 (S212), and stopped.

The moving back amount at this time is set such that the trailing edge (upstream edge in the conveying direction) of the folded bundle P1 at the second stacking position is positioned upstream in the folded bundle discharging direction of the leading edge position of the next folded bundle P2 discharged by the pair of second folding conveying rollers 812 when hanging by its self-weight so as to be discharged.

Figure 15:
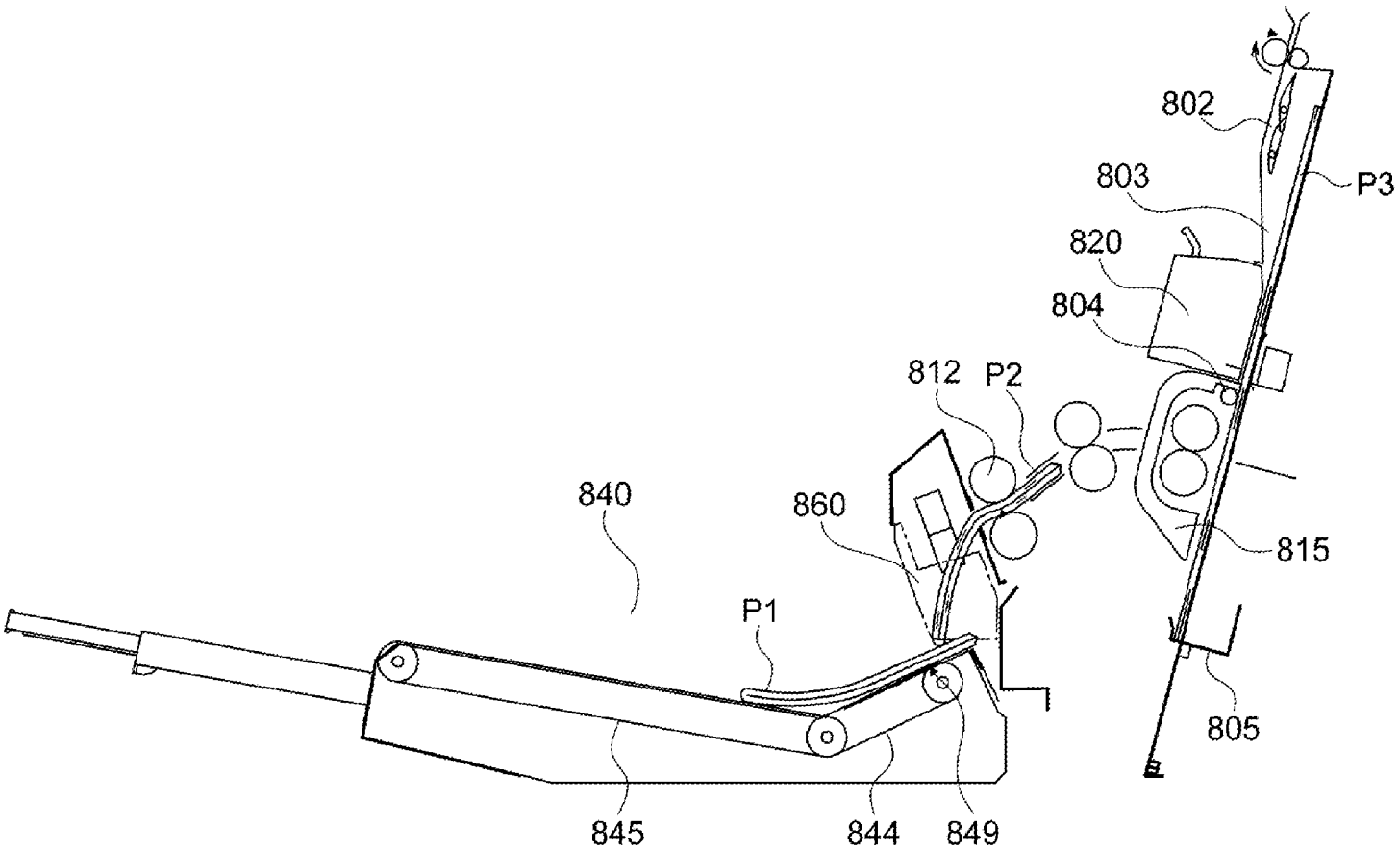
FIG. 15 is an explanatory diagram of a bundle discharging operation.
Figure 16:
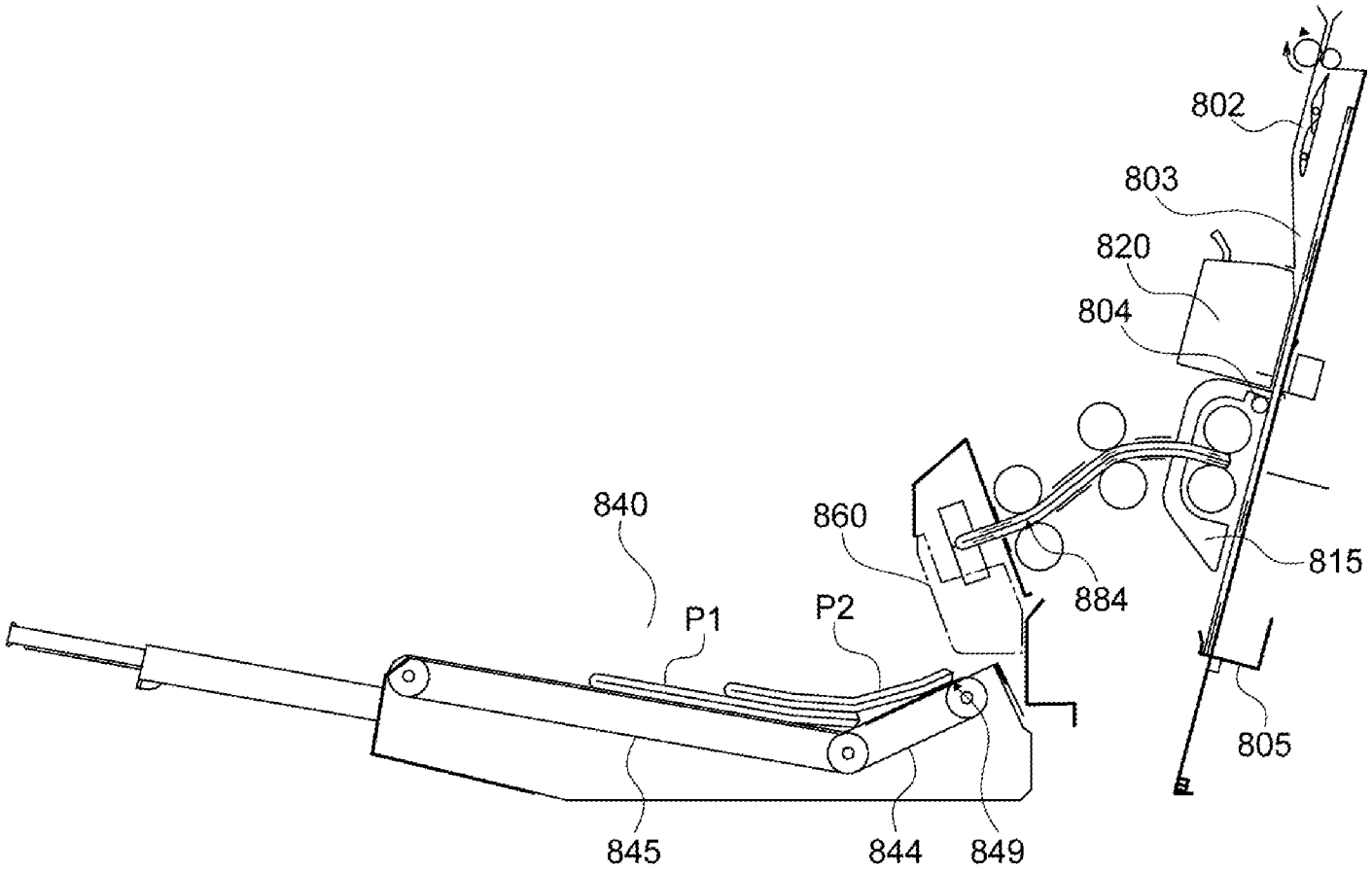
FIG. 16 is an explanatory diagram of a bundle discharging operation.

After that, as illustrated in FIG. 15, the folded bundle P2 is discharged by the pair of second folding conveying rollers 812 (S213), and its leading edge (downstream edge in the conveying direction) lands on the folded bundle P1 which is stopped at the second stacking position. In the middle of the discharge of the folded bundle P2, the conveyer belts 844, 845 are driven to rotate forwardly in the conveying direction (S214), and, as illustrated in FIG. 16, the trailing edge of the folded bundle P2 stacked on the folded bundle P1 in a stacked state is detected by the bundle detection sensor 849 (S215). Then, when the bundle detection sensor 849 detects the trailing edge of the folded bundle P2, the conveyer motor M7 is stopped, and, this time, the folded bundle P2 is stopped at the first stacking position (S216). With this, the press unit 860 can be operated without interfering with the folded bundle stacked on the folded bundle tray 840. The above-mentioned operations are repeated until a desired number of bundles have been discharged on the folded bundle tray 840 (S217), and the job is finished (S218).

Note that, in the above-mentioned case, the timing of discharging the folded bundle P2, which has been applied with the folded end portion processing, to the folded bundle tray 840 is set at a time after the folded bundle P1 has been moved back to the second stacking position, but this is not the only case. The discharging operation of the succeeding folded bundle P2 may be started before the preceding folded bundle P1 is finally moved back to the second stacking position, and the conveying velocities of the folded bundle P1 and the folded bundle P2 may be set such that the folded bundle P1 is finally moved back to the second stacking position before the leading edge (downstream edge in the conveying direction) of the folded bundle P2 lands thereon.

The length in the conveying direction of the folded bundle in the above description means a length in the conveying direction which does not make the trailing edge of the folded bundle remain in the storage region (stacking region) of the storage portion 803, i.e., 18 inches or below of the length in the sheet conveying direction before being folded (S205). Therefore, after the preceding folded bundle has been stopped at the folded end portion processing position, at the same time of performing the folded end portion processing for this preceding folded bundle, the stacking operation of the sheets for the succeeding sheet bundle following this to the storage portion is also performed (S206). Namely, before completing the folded end portion processing for the preceding folded bundle, the processing for the succeeding sheet bundle can be concurrently performed.

Figure 18:
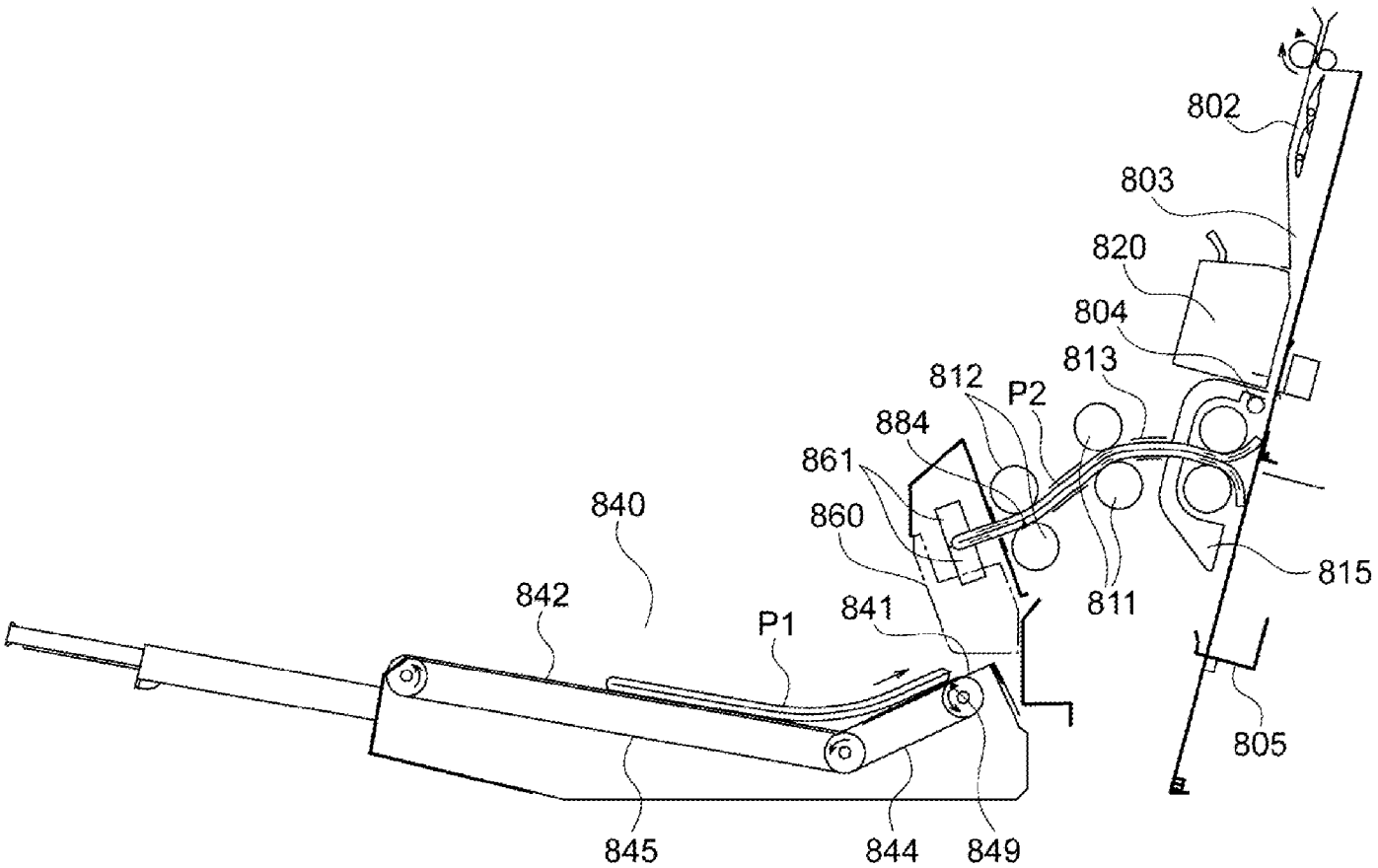
FIG. 18 is an explanatory diagram of a bundle discharging operation.
Figure 19:
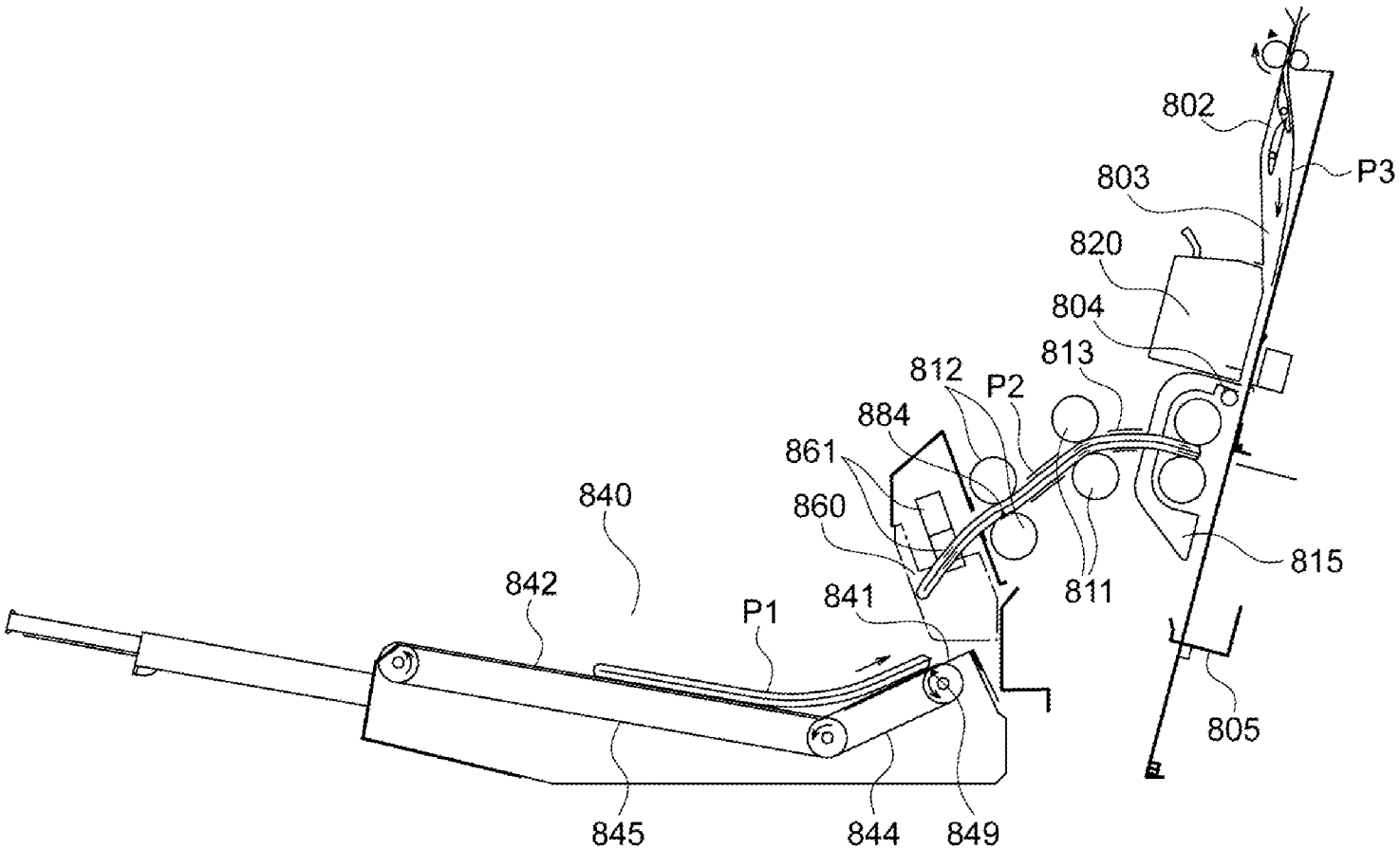
FIG. 19 is an explanatory diagram of a bundle discharging operation.
Figure 20:
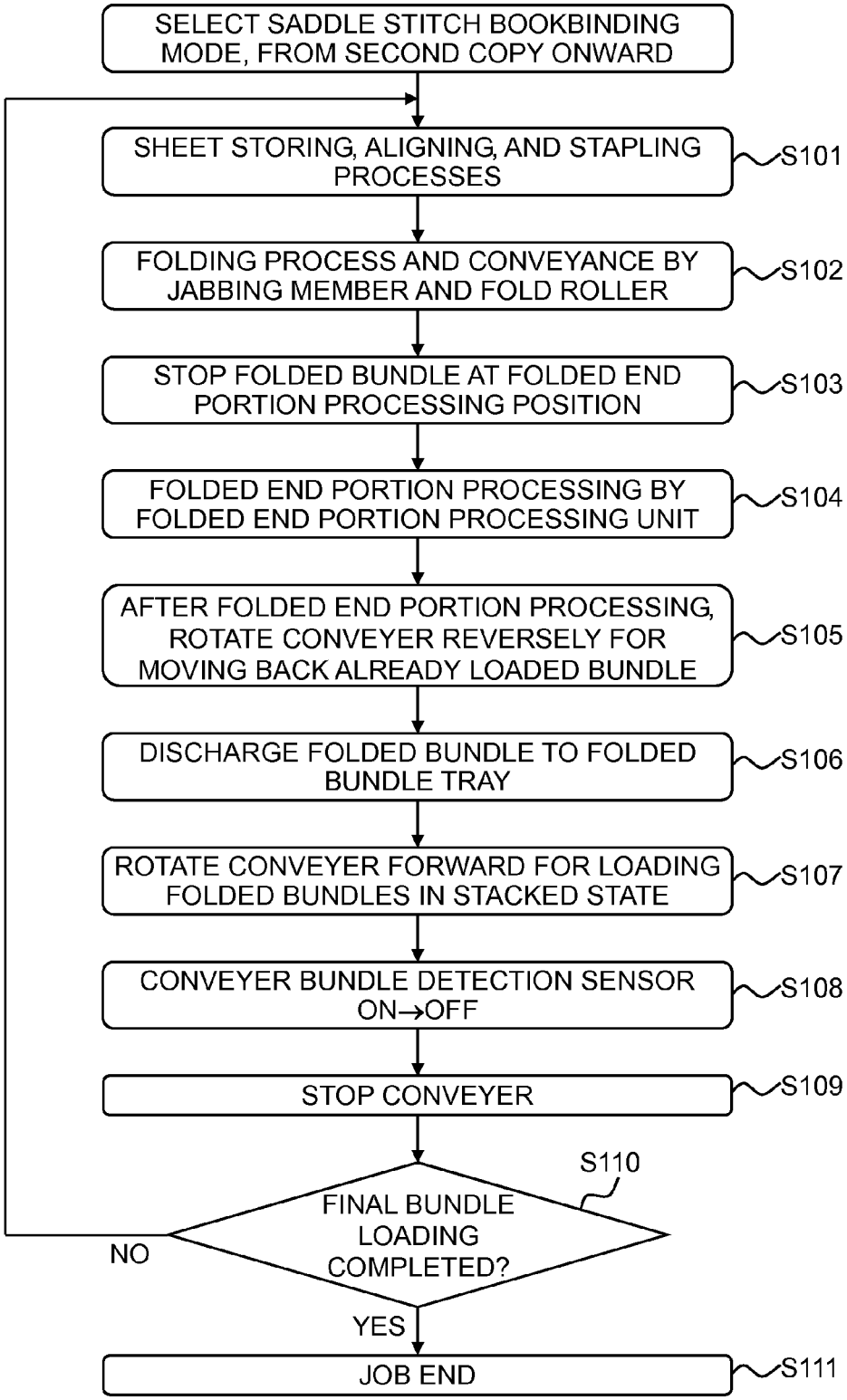
FIG. 20 PRIOR ART
FIG. 20 is a flow chart illustrating a bundle discharging operation of a conventional apparatus.
Figure 21:
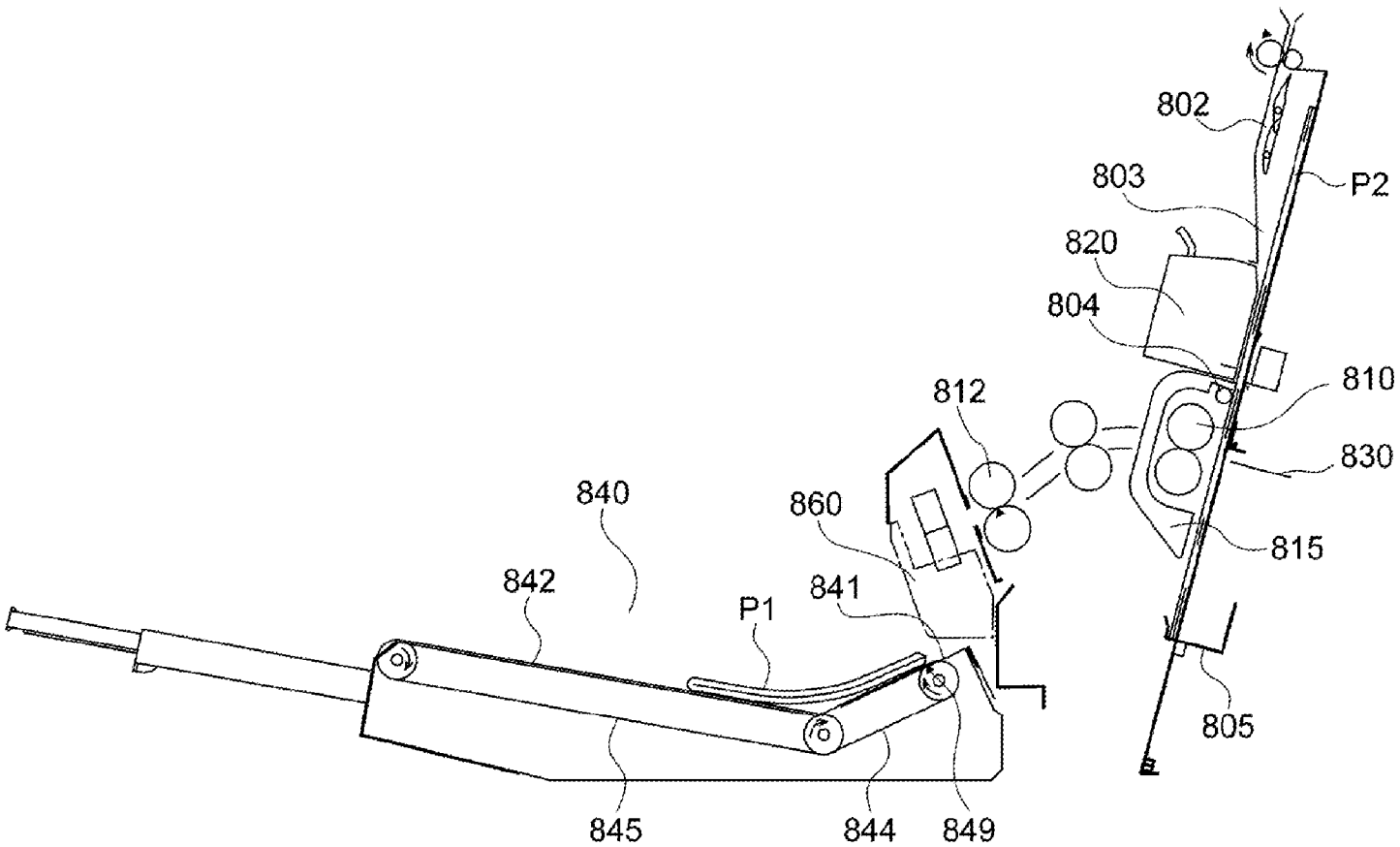
FIG. 21 PRIOR ART
FIG. 21 is a cross-sectional view of the conventional apparatus.
Figure 22:
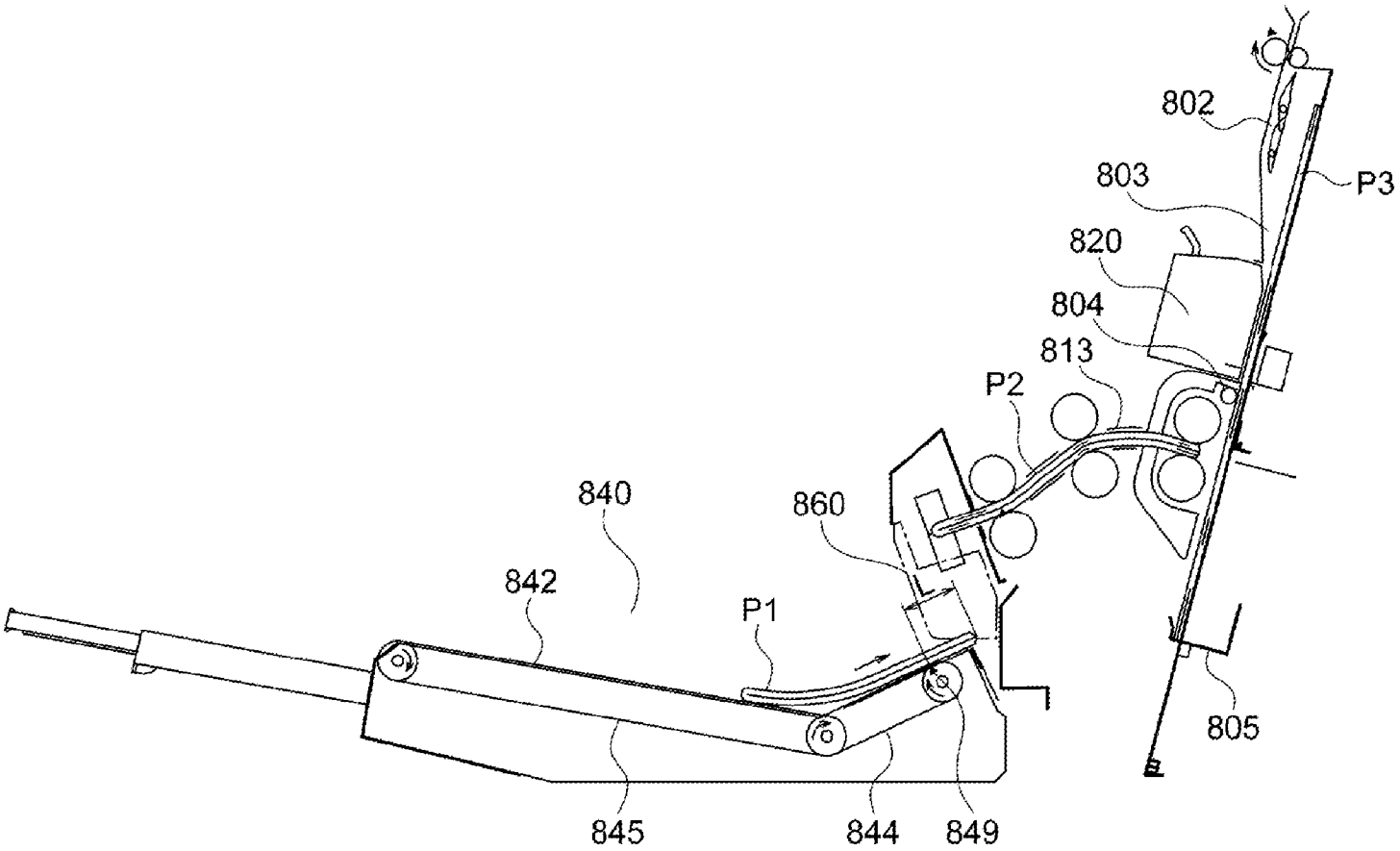
FIG. 22 PRIOR ART
FIG. 22 is a cross-sectional view of the conventional apparatus.
Figure 23:
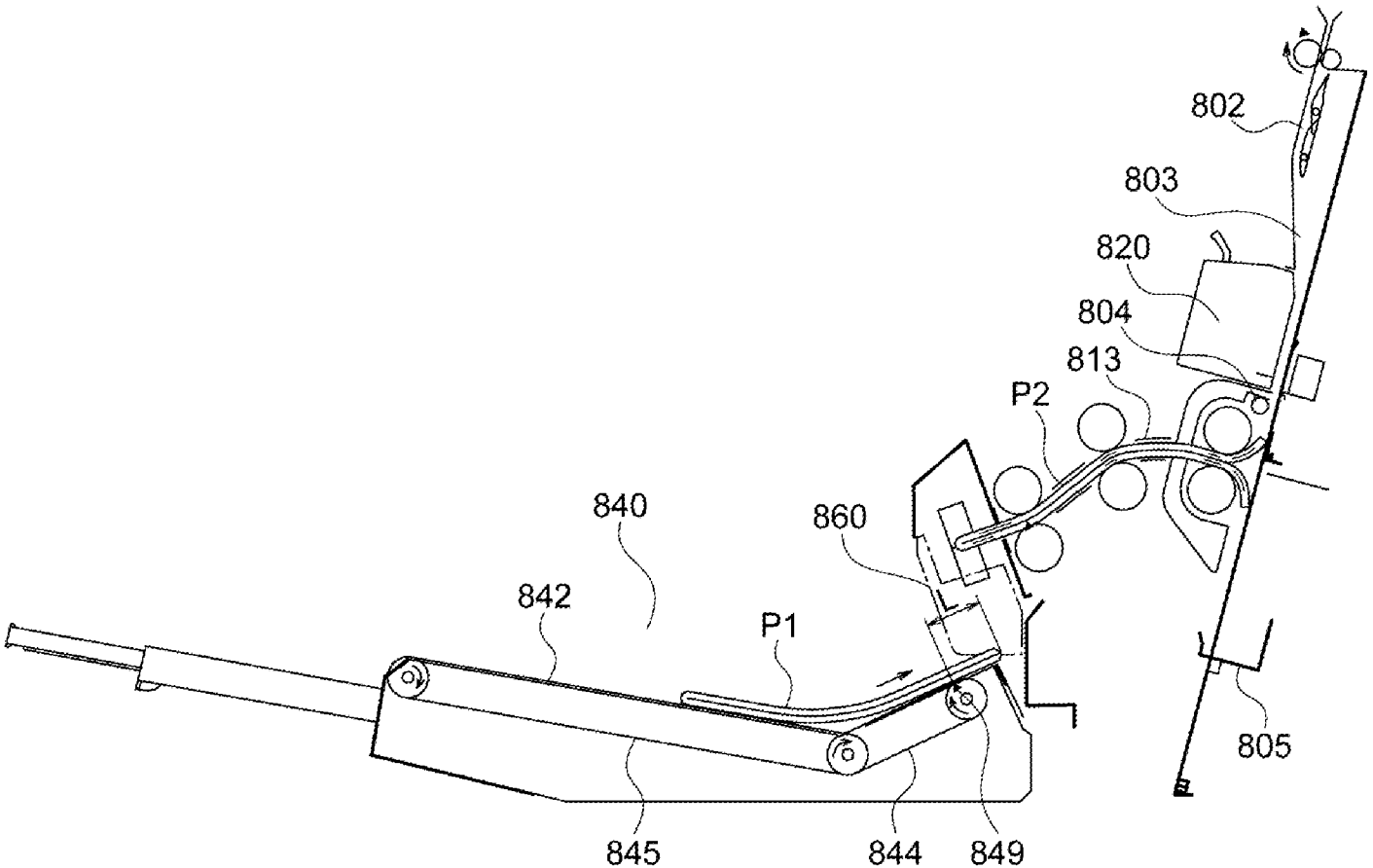
FIG. 23 PRIOR ART
FIG. 23 is a cross-sectional view of the conventional apparatus.

Next, in the case that the length in the conveying direction makes the trailing edge of the folded bundle (downstream edge in the conveying direction) remain within the storage region of the storage portion 803, there is described an operation control of the folded bundle which has already been discharged and stacked on the folded bundle tray 840 when a folded bundle is discharged, with reference to FIGS. 18 and 19. FIGS. 18 and 19 are explanatory diagrams of the bundle discharging operation.

At this time, the sheet is stacked on the storage portion 803, is bound with a staple by the stapler 820 (S202), and is applied with folding process and conveyed by the jabbing member 830 and the pair of folding rollers 810 (S203), and the folded bundle is stopped at the folded end portion processing position (S204). This operation is similar to that for the above length in the conveying direction which does not make the trailing edge of the folded bundle remain within the storage region of the storage portion 803.

Here, the length in the conveying direction which makes the trailing edge of the folded bundle remain within the storage region of the storage portion is the length of over 18 inches in the sheet conveying direction before being folded. As mentioned above, this length in the conveying direction is suitably set, and is not limited to this.

Then, in the case that the length in the conveying direction before being folded is over 18 inches for the length in the sheet conveying direction (S205), the folded end portion processing is performed by the folded end portion processing portion under state in which the trailing edge (downstream edge in the conveying direction) of the preceding folded bundle remains within the storage region of the storage portion 803 (S208, FIG. 18). Then, after the folded end portion processing for the preceding folded bundle has been finished (S209), the above folded bundle is conveyed downstream by the pair of folding conveying rollers 811, 812 until the trailing edge of this preceding folded bundle has passed through the storage portion, and is stopped (S210).

When the trailing edge (downstream edge in the conveying direction) of the folded bundle P2, which remained in the storage region of the storage portion 803, has passed therethrough, the sheet for the next sheet bundle is conveyed to the storage portion 803 (S211, FIG. 19). Namely, after the folded end portion processing for the preceding folded bundle has been finished, and its trailing edge has passed through the storage portion, the conveyance of the succeeding sheet bundle to the storage portion is started.

As illustrated in the flow chart of FIG. 17, the following folded bundle discharging operation is similar to that for the length in the conveying direction which does not make the trailing edge (downstream edge in the conveying direction) of the folded bundle remain in the storage region of the storage portion 803.

In the above-mentioned description, the folded bundle P2, which has already been applied with the folded end portion processing, is temporarily stopped at a position in which the trailing edge of the folded bundle P2 does not remain within the storage region of the storage portion 803, and is discharged to the folded bundle tray 840 after the folded bundle P1 has been moved back to the second stacking position. However, this operation is not the only case. For example, the discharge of the folded bundle P2, which has already been applied with the folded end portion processing, may be started before the folded bundle P1 has been moved back to the second stacking position, and the conveying velocities of the folded bundles P1, P2 may be set such that the leading edge of the folded bundle P2 lands on the folded bundle P1 which has been moved back to the second stacking position.

Thus, when the folded bundle is discharged after the folded end portion processing, by using the time period for moving the conveyer belt back to the bundle receiving position, the folded bundle is preliminary discharged until its trailing edge has passed through the storage region of the storage portion, thereby enabling the succeeding sheet to be conveyed into the storage portion. With this, even when the trailing edge of the folded bundle to be applied with the folded end portion processing remains within the stacking region for stacking the next sheet bundle, the interruption for the conveyance of the succeeding sheet can be shortened so that the productivity can be enhanced without increasing the size of apparatus.

The conveyer belt is moved back to the bundle receiving position in order to suppress the opening of the trailing edge of the folded bundle by stacking the folded bundles in a stacked state. If the conveyer belt is moved back under a state in which the previously stacked folded bundle is stacked thereon during the folded end portion processing, the press unit 860 and the previously stacked folded bundle may collide with each other. Therefore, after the folded end portion processing has been finished, the conveyer belt is moved to the bundle receiving position. Note that, even when preliminarily discharged as mentioned above, the conveyance of the succeeding sheet should be interrupted during the folded end portion processing for the preceding folded bundle, not only stopping the image forming, the succeeding sheet may be made to wait at a buffer.

In the above-mentioned embodiment, the sheet size (length in the conveying direction) information is obtained based on the information input by the user via the operation portion 601. Moreover, in the above-mentioned embodiment, the length in the conveying direction, which remains within the storage region of the storage portion 803, is set to be over 18 inches before being folded. However, this is determined according to the conveying path length of the bundle conveying guides 813, 814, and the length in the conveying direction, which remains within the storage region of the storage portion 803, is suitably set according to the configuration of the apparatus. Namely, when giving priority to decreasing the size of apparatus, the conveying path lengths of the bundle conveying guides 813, 814 may be shortened, but in such case, the set length in the conveying direction, which remains within the storage region of the storage portion 803, becomes shorter according to its conveying path length.

In the above-mentioned embodiment, although the folding operation of the saddle stitch bookbinding is described, a similar bundle discharging operation is performed for unbinding folding.

As mentioned above, when the length in the conveying direction of the folded bundle is longer than the conveying path lengths of the bundle conveying guides 813, 814, and the folded bundle trailing edge remains within the storage region of the storage portion 803 during the folded end portion processing, the timing of discharging the folded bundle after the folded end portion processing is advanced. By doing like this, the storage portion 803 can be made empty at a timing earlier than that of the conventional apparatus. Therefore, even during the moving back operation of the previously stacked folded bundle on the folded bundle tray 840, the sheet for a next bundle can be conveyed to the storage portion 803, as a result, the productivity can be enhanced without changing the apparatus configuration. Namely, the productivity can be enhanced without increasing the conveying path lengths of the bundle conveying guides 813, 814 according to the length in the conveying direction, so that the apparatus can be miniaturized.

In the above-mentioned embodiment, there is exemplified the sheet processing apparatus capable of being suitably disposed on the image forming apparatus main body, but the present invention is not limited to this. For example, the image forming apparatus may be integrally provided with the sheet processing apparatus, and similar effects can be obtained by applying the present invention to this sheet processing apparatus.

Moreover, in the above-mentioned embodiment, a copying machine is exemplified as the image forming apparatus, but the present invention is not limited to this. For example, other image forming apparatuses, such as a scanner, a printer, a facsimile apparatus, etc., or other image forming apparatuses, such as a multifunction machine etc. made by combining these functions. By applying the present invention to the sheet processing apparatuses used for these image forming apparatuses, similar effects can be obtained.

While the present invention has been described with reference to exemplary embodiments, it is to be understood that the invention is not limited to the disclosed exemplary embodiments. The scope of the following claims is to be accorded the broadest interpretation so as to encompass all modifications, equivalent structures and functions.

This application claims the benefit of Japanese Patent Application No. 2011-158572, filed Jul. 20, 2011, which is hereby incorporated by reference herein in its entirety.

What is claimed is:

1. A sheet processing apparatus comprising:

a sheet stacking portion on which sheets are stacked;

a folding portion which performs a double folding process to a sheet bundle made of a plurality of sheets which are stacked on the sheet stacking portion;

a folded bundle conveying portion which conveys a folded bundle double folded by the folding portion;

a folded end portion processing portion which processes a folded end portion of the folded bundle by abutting the folded end portion and moving in a direction orthogonal to a conveying direction;

a folded bundle stacking portion on which a folded bundle discharged from the folded bundle conveying portion is stacked;

a folded bundle transfer portion disposed on the folded bundle stacking portion, the folded bundle transfer portion moving the folded bundle stacked on the folded bundle stacking portion between a first stacking position where an upstream edge thereof in the conveying direction does not interfere with the folded end portion processing portion during a folded end portion processing, and a second stacking position which is closer to the folded bundle conveying portion than the first stacking position, such that the upstream edge in the conveying direction of the folded bundle stacked on the folded bundle stacking portion is positioned upstream in the conveying direction of a downstream edge in the conveying direction of the folded bundle to be discharged by the folded bundle conveying portion; and a controller which controls operations of the folded bundle conveying portion, the folded end portion processing portion, and the folded bundle transfer portion, wherein the controller:

controls the folded bundle transfer portion so that, after a preceding folded bundle stacked on the folded bundle stacking portion has been moved to the first stacking position, the preceding folded bundle is moved to the second stacking position such that a succeeding folded bundle discharged to the folded bundle stacking portion abuts the preceding folded bundle, and controls the folded bundle conveying portion so that, in a case that the succeeding folded bundle has a length in the conveying direction such that the upstream edge in the conveying direction of the succeeding folded bundle remains within a stacking region of the sheet stacking portion when the succeeding folded bundle is temporarily stopped for the folded end portion processing, after the folded end portion processing has been applied, the succeeding folded bundle is conveyed until the upstream edge in the conveying direction of the succeeding folded bundle passes through outside the stacking region of the sheet stacking portion before the preceding folded bundle reaches the second stacking position.

2. The sheet processing apparatus according to claim 1, wherein the controller controls the folded bundle transfer portion so that the preceding folded bundle reaches the second stacking position before the downstream edge in the conveying direction of the succeeding folded bundle discharged by the folded bundle conveying portion lands on the preceding folded bundle.

3. The sheet processing apparatus according to claim 1, wherein, in a case that the succeeding folded bundle has a length in the conveying direction such that the upstream edge in the conveying direction of the succeeding folded bundle does not remain within a stacking region of the sheet stacking portion when the succeeding folded bundle is temporarily stopped for the folded end portion processing, after the folded end portion processing has been applied, a stacking of a sheet for a next sheet bundle on the sheet stacking portion is started before starting a conveyance of the succeeding folded bundle, and wherein, in a case that the succeeding folded bundle has the length in the conveying direction such that the upstream edge in the conveying direction of the succeeding folded bundle remains within a stacking region of the sheet stacking portion when the succeeding folded bundle is temporarily stopped for the folded end portion processing, after the folded end portion processing has been applied, the succeeding folded bundle is conveyed until the upstream edge thereof in the conveying direction passes through outside the stacking region of the sheet stacking portion, and a stacking of a sheet for a next sheet bundle to the sheet stacking portion is started.

4. The sheet processing apparatus according to claim 1, further comprising a binding portion which applies a binding process to the sheet bundle stacked on the sheet stacking portion, wherein the folded portion is applied with a folding process at a binding position of the sheet bundle which has been applied with the binding process by the binding portion.

5. An image forming apparatus comprising:

an image forming portion which forms an image on a sheet;

a sheet processing apparatus which processes a sheet bundle made of a plurality of sheets on which images have been formed; and a controller which controls an operation of the sheet processing apparatus, wherein the sheet processing apparatus includes:

a sheet stacking portion on which sheets are stacked;

a folding portion which performs a double folding process to a sheet bundle made of a plurality of sheets which are stacked on the sheet stacking portion;

a folded bundle conveying portion which conveys a folded bundle double folded by the folding portion;

a folded end portion processing portion which processes a folded end portion of the folded bundle by abutting the folded end portion and moving in a direction orthogonal to a conveying direction;

a folded bundle stacking portion on which a folded bundle discharged from the folded bundle conveying portion is stacked; and a folded bundle transfer portion disposed on the folded bundle stacking portion, the folded bundle transfer portion moving the folded bundle stacked on the folded bundle stacking portion between a first stacking position where an upstream edge thereof in the conveying direction does not interfere with the folded end portion processing portion during a folded end portion processing, and a second stacking position which is closer to the folded bundle conveying portion than the first stacking position, such that the upstream edge in the conveying direction of the folded bundle stacked on the folded bundle stacking portion is positioned upstream in the conveying direction of a downstream edge in the conveying direction of the folded bundle to be discharged by the folded bundle conveying portion, and wherein the controller:

controls the folded bundle transfer portion so that, after a preceding folded bundle stacked on the folded bundle stacking portion has been moved to the first stacking position, the preceding folded bundle is moved to the second stacking position such that a succeeding folded bundle discharged to the folded bundle stacking portion abuts the preceding folded bundle, and controls the folded bundle conveying portion so that, in a case that the succeeding folded bundle has a length in the conveying direction such that the upstream edge in the conveying direction of the succeeding folded bundle remains within a stacking region of the sheet stacking portion when the succeeding folded bundle is temporarily stopped for the folded end portion processing, after the folded end portion processing has been applied, the succeeding folded bundle is conveyed until the upstream edge in the conveying direction of the succeeding folded bundle passes through outside the stacking region of the sheet stacking portion before the preceding folded bundle reaches the second stacking position.

6. The image forming apparatus according to claim 5, wherein the controller controls the folded bundle transfer portion so that the preceding folded bundle reaches the second stacking position before the downstream edge in the conveying direction of the succeeding folded bundle discharged by the folded bundle conveying portion lands on the preceding folded bundle.

7. The image forming apparatus according to claim 5, wherein, in a case that the succeeding folded bundle has a length in the conveying direction that the upstream edge in the conveying direction of the succeeding folded bundle does not remain within a stacking region of the sheet stacking portion when the succeeding folded bundle is temporarily stopped for the folded end portion processing, after the folded end portion processing has been applied, a stacking of a sheet for a next sheet bundle on the sheet stacking portion is started before starting a conveyance of the succeeding folded bundle, and wherein, in a case that the succeeding folded bundle has the length in the conveying direction such that the upstream edge in the conveying direction of the succeeding folded bundle remains within a stacking region of the sheet stacking portion when the succeeding folded bundle is temporarily stopped for the folded end portion processing, after the folded end portion processing has been applied, the succeeding folded bundle is conveyed until the upstream edge thereof in the conveying direction passes through outside the stacking region of the sheet stacking portion, and a stacking of a sheet for a next sheet bundle to the sheet stacking portion is started.

8. The image forming apparatus according to claim 5, further comprising a binding portion which applies a binding process to the sheet bundle stacked on the sheet stacking portion, wherein the folded portion is applied with a folding process at a binding position of the sheet bundle which has been applied with the binding process by the binding portion.

* * * * *